US009846383B2

(12) United States Patent
Murata

(10) Patent No.: US 9,846,383 B2
(45) Date of Patent: Dec. 19, 2017

(54) IMAGE FORMATION DEVICE HAVING DETERMINATION OF CHARGE VOLTAGE

(71) Applicant: Konica Minolta, Inc., Tokyo (JP)

(72) Inventor: Hisashi Murata, Toyohashi (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/377,242

(22) Filed: Dec. 13, 2016

(65) Prior Publication Data

US 2017/0219950 A1 Aug. 3, 2017

(30) Foreign Application Priority Data

Feb. 2, 2016 (JP) ..... 2016-017785

(51) Int. Cl.
*G03G 15/02* (2006.01)

(52) U.S. Cl.
CPC ..... *G03G 15/0266* (2013.01)

(58) Field of Classification Search
CPC . G03G 15/0266; G03G 21/20; G03G 2215/02
USPC ..... 399/44, 50
See application file for complete search history.

(56) References Cited

U.S. PATENT DOCUMENTS 7,684,719 B2 * 3/2010 Kitajima ..... G03G 15/0266 399/168
9,665,030 B2 * 5/2017 Kato ..... G03G 15/0266
9,727,003 B2 * 8/2017 Yoshida ..... G03G 15/0283
2002/0102108 A1 * 8/2002 Adachi ..... G03G 15/0216 399/50
2010/0111550 A1 * 5/2010 Kubo ..... G03G 15/0216 399/50
2010/0239286 A1 * 9/2010 Hanashi ..... G03G 15/0266 399/50
2012/0033984 A1 * 2/2012 Ikeda ..... G03G 15/0216 399/50
2013/0177328 A1 * 7/2013 Fukuda ..... G03G 15/0266 399/43

(Continued)

FOREIGN PATENT DOCUMENTS

JP 2001201920 A 7/2001
JP 2008170948 A * 7/2008

*Primary Examiner* — Robert Beatty
(74) *Attorney, Agent, or Firm* — Lucas & Mercanti, LLP

(57) ABSTRACT

An image formation device in which an image carrier is charged by a charging member includes: a power source configured to supply a charge voltage to the charging member, the charge voltage being formed such that an AC voltage is superimposed on a DC voltage; a detection unit configured to detect an alternating current value flowing through the charging member; and a control unit configured to control a peak-to-peak voltage value of the AC voltage, wherein the control unit executes: first processing of sequentially supplying a plurality of charge voltages from the power source to the charging member in non-image formation; second processing of obtaining, from an alternating current value detection result, a third approximate function indicating a difference value between a first approximate function and a second approximate function; and third processing of determining one of different predetermined ranges and determining a peak-to-peak voltage value in image formation.

15 Claims, 12 Drawing Sheets

(56) References Cited

U.S. PATENT DOCUMENTS

| | | | | |
|---|---|---|---|---|
| 2014/0363182 | A1* | 12/2014 | Yoshida | G03G 15/0283 399/50 |
| 2016/0252838 | A1* | 9/2016 | Kato | G03G 15/0266 399/50 |
| 2016/0252840 | A1* | 9/2016 | Murata | G03G 15/0266 399/50 |
| 2016/0349657 | A1* | 12/2016 | Nagahashi | G03G 15/0266 |

* cited by examiner

FIG. 4

ENVIRONMENTAL STEP TABLE 81

| | | MACHINE INNER TEMPERATURE (°C) | | | | | | |
|---|---|---|---|---|---|---|---|---|
| | | <15 | <20 | <24 | <28 | <32 | <44 | 44≥ |
| MACHINE INNER HUMIDITY (%) | <18 | 1 | 1 | 1 | 2 | 2 | 2 | 2 |
| | <32 | 2 | 2 | 2 | 2 | 3 | 4 | 6 |
| | <55 | 3 | 5 | 5 | 7 | 7 | 8 | 9 |
| | <65 | 4 | 5 | 7 | 7 | 8 | 9 | 10 |
| | <75 | 6 | 6 | 7 | 8 | 9 | 10 | 11 |
| | <85 | 8 | 8 | 9 | 9 | 11 | 12 | 14 |
| | 85≥ | 10 | 11 | 12 | 13 | 14 | 15 | 16 |

FIG. 5

DETECTION VOLTAGE TABLE 82

| | | ENVIRONMENTAL STEP | | | |
|---|---|---|---|---|---|
| | | 1 TO 3 (LL) (GROUP A) | 4 TO 7 (NN) (GROUP B) | 8 TO 12 (GROUP C) | 13 TO 16 (HH) (GROUP D) |
| PEAK-TO-PEAK VOLTAGE VALUE (V) FOR DETECTION | 1 | 1020 | 1020 | 1020 | 1020 |
| | 2 | 1080 | 1080 | 1080 | 1080 |
| | 3 | 1140 | 1140 | 1140 | 1140 |
| | 4 | 1200 | 1200 | 1200 | 1200 |
| | 5 | 1650 | 1600 | 1550 | 1550 |
| | 6 | 1750 | 1700 | 1650 | 1650 |
| | 7 | 2000 | 1800 | 1750 | 1750 |
| | 8 | 2100 | 1866 | 1833 | 1833 |
| | 9 | 2200 | 1932 | 1916 | 1916 |
| | 10 | 2300 | 2000 | 2000 | 2000 |

FIG. 10

SLOPE DETERMINATION TABLE

83

| | | ENVIRONMENTAL STEP | | | | | |
|---|---|---|---|---|---|---|---|
| | | 1 TO 2 | 3 TO 4 | 5 TO 6 | 7 | 8 TO 12 | 13 TO 16 |
| ALTERNATING CURRENT VALUE Iac (μA) IN APPLICATION OF 2000 V | 4281 OR MORE | 2.0 | 1.6 | 1.5 | 2.4 | 2.3 | 1.8 |
| | 3921 TO 4280 | 2.3 | 1.6 | 1.5 | 2.4 | 2.3 | 1.8 |
| | 3271 TO 3920 | 2.3 | 1.6 | 1.5 | 2.6 | 2.5 | 1.8 |
| | 2631 TO 3270 | 2.3 | 1.6 | 1.7 | 2.6 | 2.5 | 1.8 |
| | 2561 TO 2630 | 2.5 | 1.6 | 1.7 | 2.6 | 2.5 | 2.1 |
| | 2461 TO 2560 | 2.8 | 2.5 | 1.7 | 2.6 | 2.5 | 2.1 |
| | 2401 TO 2460 | 3.3 | 2.5 | 1.7 | 2.6 | 2.5 | 2.1 |
| | LESS THAN 2400 | 3.6 | 2.5 | 1.7 | 2.6 | 2.5 | 2.1 |

FIG. 11

| | | INITIAL STAGE OF LIFE | TERMINAL STAGE OF LIFE |
|---|---|---|---|
| | OPTIMAL VALUE (V) OF PEAK-TO-PEAK VOLTAGE | 2150 | 1480 |
| METHOD IN WHICH ΔIac IS FIXED AT PREDETERMINED VALUE D | ΔIac (μA) | 210 | 210 |
| | CALCULATED Vpp (V) | 2150 | 1740 |
| | DIFFERENCE ΔVd (= CALCULATED Vpp − OPTIMAL VALUE) | 0 | 260 |
| METHOD IN WHICH SLOPE OF DIFFERENCE FUNCTION IS CERTAIN VALUE | ΔIac (μA) | 210 | 130 |
| | CALCULATED Vpp (V) | 2150 | 1500 |
| | DIFFERENCE ΔVd (= CALCULATED Vpp − OPTIMAL VALUE) | 0 | 20 |

FIG. 13

| PHOTORECEPTOR | | NEW ARTICLE | DURABLE ARTICLE |
|---|---|---|---|
| ROLLER RESISTANCE | | UPPER LIMIT | LOWER LIMIT |
| Iac (μA) IN APPLICATION OF 2000 V | | 2370 | 3582 |
| PEAK-TO-PEAK VOLTAGE VALUE Vppt (V) WITH WHICH FAVORABLE IMAGE IS OBTAINED | | 2400 | 1560 |
| (EXAMPLE WITH DETERMINATION OF k) | k | 3.6 | 2.3 |
| | CALCULATE Vpp | 2460 | 1623 |
| | DIFFERENCE ΔVd (= CALCULATED Vpp − Vppt) | 60 | 63 |
| COMPARATIVE EXAMPLE (WITH FIXED k) (k = 4) | CALCULATE Vpp | 2414 | 1342 |
| | DIFFERENCE ΔVd (= CALCULATED Vpp − Vppt) | 14 | −218 |

| ENVIRONMENT | | | LL | HH |
|---|---|---|---|---|
| Iac (μA) IN APPLICATION OF 2000 V | | | 3582 | 4246 |
| PEAK-TO-PEAK VOLTAGE VALUE Vppt (V) WITH WHICH FAVORABLE IMAGE IS OBTAINED | | | 1560 | 1300 |
| k | 2. 3 | CALCULATE Vpp | 1623 | 1272 |
| | | DIFFERENCE ΔVd (= CALCULATED Vpp − Vppt) | 63 | −28 |
| | 1. 8 | CALCULATE Vpp | 1749 | 1386 |
| | | DIFFERENCE ΔVd (= CALCULATED Vpp − Vppt) | 189 | 86 |

IMAGE FORMATION DEVICE HAVING DETERMINATION OF CHARGE VOLTAGE

The entire disclosure of Japanese Patent Application No. 2016-017785 filed on Feb. 2, 2016 including description, claims, drawings, and abstract are incorporated herein by reference in its entirety.

BACKGROUND OF THE INVENTION

Field of the Invention

The present invention relates to an image formation device configured such that a charge voltage formed by superimposition of an AC voltage on a DC voltage is supplied to a charging member to charge an image carrier.

Description of the Related Art

Examples of the technique of charging an image carrier such as a photosensitive drum in an image formation device such as a printer include the technique of charging an image carrier by a charging member, such as a charging roller and a charging brush, disposed in contact with a surface of the image carrier or disposed close to the surface of the image carrier with a certain spacing. In this charging technique, it is often configured such that a charge voltage formed by superimposition of an AC voltage on a DC voltage is supplied to the charging member.

JP 2001-201920 A discloses a configuration in which the level of peak-to-peak voltage is set to a proper value to stably perform discharging between an image carrier and a charging member based on the premise that there is the effect of averaging charge of the image carrier when a peak-to-peak voltage of an AC voltage has a value of equal to or greater than twice as great as a charge start voltage.

Specifically, in each of a first range in which the peak-to-peak voltage is lower than twice as high as the charge start voltage and a second range in which the peak-to-peak voltage is equal to or higher than twice as high as the charge start voltage, AC voltages with different detection peak-to-peak voltages are sequentially applied to the charging member, and the value of alternating current flowing through the charging member is sequentially detected.

Based on each detection value of the alternating current flowing through the charging member, an approximate function $fI1(Vpp)$ of the alternating current value for the peak-to-peak voltage in the first range and an approximate function $fI2(Vpp)$ of the alternating current value for the peak-to-peak voltage in the second range are obtained. Then, a peak-to-peak voltage value when a difference $[=fI2(Vpp)-fI1(Vpp)]$ between the approximate functions $fI1(Vpp)$, $fI2(Vpp)$ is a predetermined value D is determined as a proper value.

However, as a result of experiment by the inventor(s) of the present invention, it has been found that the proper peak-to-peak voltage value is not always obtained in the configuration in which the above-described difference is fixed to the predetermined value D.

Specifically, even when the peak-to-peak voltage value obtained from the predetermined value D is proper in a brand-new state of the image carrier, if an image carrier surface is progressively worn out due to repeated printing for a long period of time, the peak-to-peak voltage value obtained from the same predetermined value D becomes extremely greater than a proper value at each point due to, e.g., a decrease in an electric resistance value of the image carrier. This leads to great damage on the image carrier. As a result, wearing out of the image carrier is further accelerated, and the image carrier early reaches the end of the life thereof.

SUMMARY OF THE INVENTION

The present invention has been made in view of the above-described problems, and an object of the present invention is to provide an image formation device being able to obtain a more proper peak-to-peak voltage value.

To achieve the abovementioned object, according to an aspect, an image formation device in which an image carrier is charged by a charging member, reflecting one aspect of the present invention comprises: a power source configured to supply a charge voltage to the charging member, the charge voltage being formed such that an AC voltage is superimposed on a DC voltage; a detection unit configured to detect an alternating current value flowing through the charging member; and a control unit configured to control a peak-to-peak voltage value of the AC voltage, wherein the control unit executes: first processing of sequentially supplying a plurality of charge voltages from the power source to the charging member in non-image formation, the charge voltages having different peak-to-peak voltage values in a first discharge range in which only charge transfer from the charging member to the image carrier occurs and a second discharge range in which charge transfer occurs in both directions between the image carrier and the charging member; second processing of obtaining, from an alternating current value detection result obtained by the detection unit when each charge voltage is supplied by the first processing, a third approximate function indicating a difference value between a first approximate function and a second approximate function, the first approximate function indicating an alternating current value for each peak-to-peak voltage value in the first discharge range and the second approximate function indicating an alternating current value for each peak-to-peak voltage value in the second discharge range; and third processing of determining one of different predetermined ranges to which a detection value of the alternating current value in supply of one of the charge voltages with an associated one of the peak-to-peak voltage values in the second discharge range belongs, and determining, as a peak-to-peak voltage value in image formation, a peak-to-peak voltage value at a point at which a change amount of the difference value per unit peak-to-peak voltage is coincident with a predetermined change amount value corresponding to the determined range in the third approximate function.

The associated one of the peak-to-peak voltage values is preferably one of the peak-to-peak voltage values in the second discharge range.

The associated one of the peak-to-peak voltage values is preferably a greatest one of the peak-to-peak voltage values in the second discharge range.

The third approximate function is preferably obtained by subtraction of the first approximate function from the second approximate function, and the associated one of the peak-to-peak voltage values is preferably one of peak-to-peak voltage values which are included in the peak-to-peak voltage values in the second discharge range and for which the difference value is greater than zero.

The image formation device preferably further comprises: a detection unit configured to detect an environmental condition inside or outside a machine, wherein for each of the different predetermined ranges, different values of the change amount is, in advance, associated respectively with different environmental conditions, and in the third processing, one of the different values of the change amount associated in advance with the determined range and corresponding to one of the different environmental conditions detected by the detection unit is set as the predetermined change amount value.

The environmental condition is preferably at least one of a temperature or a humidity inside the machine.

The charging member is preferably in a roller, brush, or blade shape contacting the image carrier or disposed close to the image carrier.

To achieve the abovementioned object, according to an aspect, there is provided a non-transitory recording medium storing a computer readable control program of an image formation device in which an image carrier is charged by a charging member, wherein the image formation device includes: a power source configured to supply a charge voltage to the charging member, the charge voltage being formed such that an AC voltage is superimposed on a DC voltage; and a detection unit configured to detect an alternating current value flowing through the charging member, the program reflecting one aspect of the present invention causes a computer to execute: a first processing step of sequentially supplying a plurality of charge voltages from the power source to the charging member in non-image formation, the charge voltages having different peak-to-peak voltage values in a first discharge range in which only charge transfer from the charging member to the image carrier occurs and a second discharge range in which charge transfer occurs in both directions between the image carrier and the charging member; a second processing step of obtaining, from an alternating current value detection result obtained by the detection unit when each charge voltage is supplied by the first processing, a third approximate function indicating a difference value between a first approximate function and a second approximate function, the first approximate function indicating an alternating current value for each peak-to-peak voltage value in the first discharge range and the second approximate function indicating an alternating current value for each peak-to-peak voltage value in the second discharge range; and a third processing step of determining one of different predetermined ranges to which a detection value of the alternating current value in supply of one of the charge voltages with an associated one of the peak-to-peak voltage values in the second discharge range belongs, and determining, as a peak-to-peak voltage value in image formation, a peak-to-peak voltage value at a point at which a change amount of the difference value per unit peak-to-peak voltage is coincident with a predetermined change amount value corresponding to the determined range in the third approximate function, and a peak-to-peak voltage value of the AC voltage is controlled by the first to third processing steps.

The associated one of the peak-to-peak voltage values is preferably one of the peak-to-peak voltage values in the second discharge range.

The associated one of the peak-to-peak voltage values is preferably a greatest one of the peak-to-peak voltage values in the second discharge range.

The third approximate function is preferably obtained by subtraction of the first approximate function from the second approximate function, and the associated one of the peak-to-peak voltage values is preferably one of peak-to-peak voltage values which are included in the peak-to-peak voltage values in the second discharge range and for which the difference value is greater than zero.

The image formation device preferably further includes a detection unit configured to detect an environmental condition inside or outside a machine, for each of the different predetermined ranges, different values of the change amount is preferably, in advance, associated respectively with different environmental conditions, and in the third processing step, one of the different values of the change amount associated in advance with the determined range and corresponding to one of the different environmental conditions detected by the detection unit is preferably set as the predetermined change amount value.

The environmental condition is preferably at least one of a temperature or a humidity inside the machine.

The charging member is preferably in a roller, brush, or blade shape contacting the image carrier or disposed close to the image carrier.

To achieve the abovementioned object, according to an aspect, a method for controlling an image formation device in which an image carrier is charged by a charging member and which includes a power source configured to supply a charge voltage to the charging member, the charge voltage being formed such that an AC voltage is superimposed on a DC voltage, and a detection unit configured to detect an alternating current value flowing through the charging member, reflecting one aspect of the present invention comprises: a first processing step of sequentially supplying a plurality of charge voltages from the power source to the charging member in non-image formation, the charge voltages having different peak-to-peak voltage values in a first discharge range in which only charge transfer from the charging member to the image carrier occurs and a second discharge range in which charge transfer occurs in both directions between the image carrier and the charging member; a second processing step of obtaining, from an alternating current value detection result obtained by the detection unit when each charge voltage is supplied by the first processing, a third approximate function indicating a difference value between a first approximate function and a second approximate function, the first approximate function indicating an alternating current value for each peak-to-peak voltage value in the first discharge range and the second approximate function indicating an alternating current value for each peak-to-peak voltage value in the second discharge range; and a third processing step of determining one of different predetermined ranges to which a detection value of the alternating current value in supply of one of the charge voltages with an associated one of the peak-to-peak voltage values in the second discharge range belongs, and determining, as a peak-to-peak voltage value in image formation, a peak-to-peak voltage value at a point at which a change amount of the difference value per unit peak-to-peak voltage is coincident with a predetermined change amount value corresponding to the determined range in the third approximate function, wherein a peak-to-peak voltage value of the AC voltage is controlled by the first to third processing steps.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 4 is a configuration example of an environmental step table;

FIG. 5 is a configuration example of a detection voltage table;

FIG. 10 is a configuration example of a slope determination table;

FIG. 11 is a table for comparting between a peak-to-peak voltage value obtained by the method using ΔIac fixed to a certain value D and a peak-to-peak voltage value obtained by the method using a constant value k as dΔIac/dVpp;

FIG. 13 is a table of an experimental result example in an example and a comparative example;

DESCRIPTION OF THE PREFERRED EMBODIMENTS

Hereinafter, a tandem color printer (hereinafter merely referred to as a "printer") will be described as an example of an embodiment of an image formation device of the present invention with reference to the drawings. However, the scope of the invention is not limited to the illustrated examples.

(1) Entire Configuration of Printer

Figure 1:
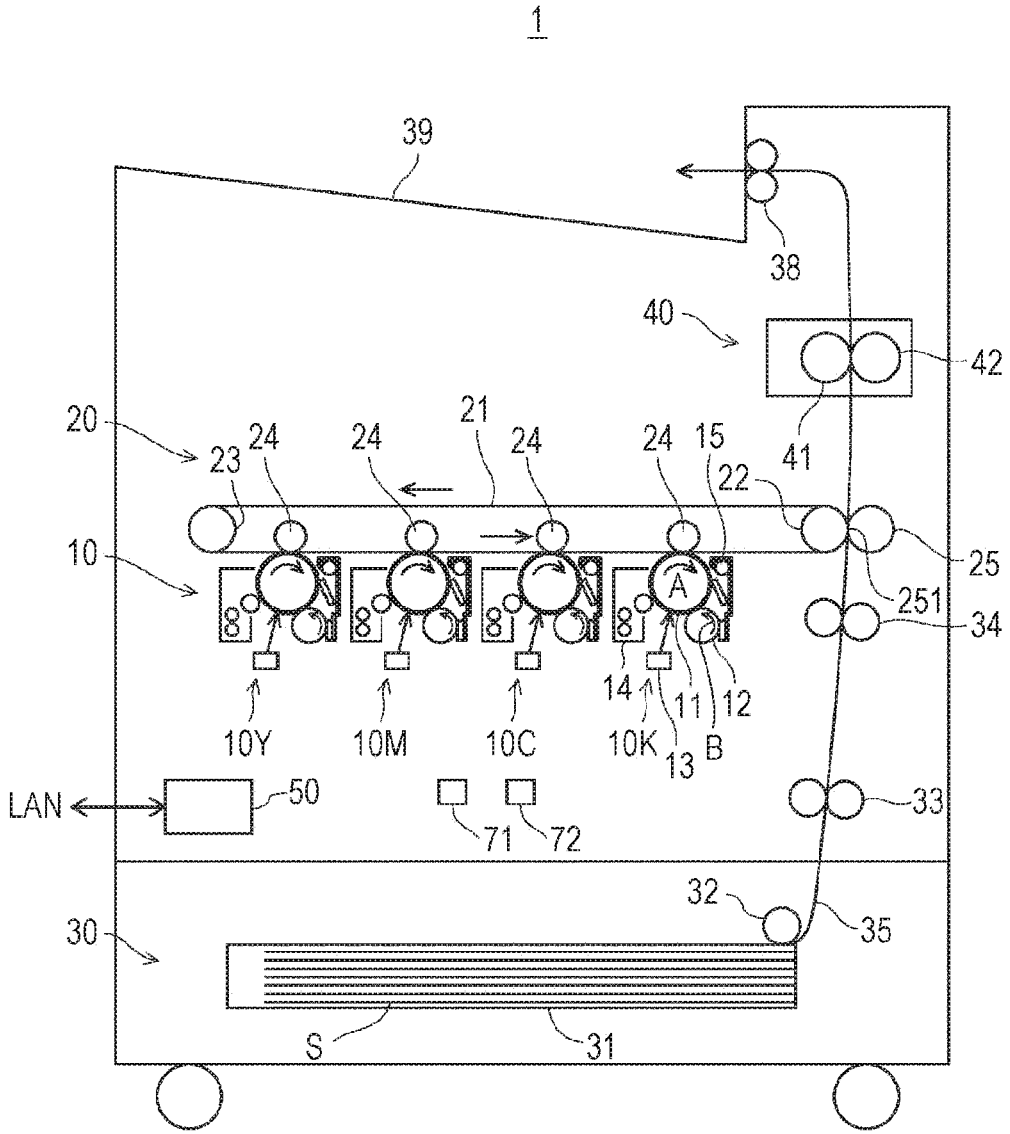
FIG. 1 is a schematic view of an entire configuration of a printer.

FIG. 1 is a schematic view of an entire configuration of a printer 1.

As illustrated in FIG. 1, the printer 1 is configured to form an image by an electrophotographic technique. The printer 1 includes an image processing section 10, an intermediate transfer section 20, a feeding section 30, a fixing section 40, and a control section 50, and is configured to execute color image formation (printing) based on a job execution request from an external terminal device (not-shown) via a network (e.g., a LAN).

The image processing section 10 includes image formation sections 10Y, 10M, 10C, 10K corresponding respectively to colors of yellow (Y), magenta (M), cyan (C), and black (K).

The image formation section 10K includes, for example, a photosensitive drum 11 configured to rotate in a direction indicated by an arrow A, a charging roller 12 disposed at the periphery of the photosensitive drum 11, an exposure section 13, a development section 14, and a cleaner 15.

The charging roller 12 is in a shape elongated along the axial direction of the photosensitive drum 11, and is configured to charge the photosensitive drum 11 while rotating in contact with a peripheral surface of the photosensitive drum 11 in a direction indicated by an arrow B. Such charging is performed in such a manner that a charge voltage is supplied from a power source 60 (FIG. 2) to the charging roller 12.

The exposure section 13 is configured to expose the charged photosensitive drum 11 with a light beam to form an electrostatic latent image on the photosensitive drum 11.

The development section 14 is configured to develop, with toner in the color K, the electrostatic latent image on the photosensitive drum 11. In this manner, a toner image in the color K is formed on the photosensitive drum 11. The toner image formed in the color K on the photosensitive drum 11 is primarily transferred onto an intermediate transfer belt 21 of the intermediate transfer section 20.

The cleaner 15 is configured to remove, e.g., toner and paper dust remaining on the surface of the photosensitive drum 11 after primary transfer to clean up the surface of the photosensitive drum 11. Note that the other image formation sections 10Y, 10M, 10C also have configurations similar to that of the image formation section 10K, and therefore, reference numerals for these sections are omitted from FIG. 1.

The intermediate transfer section 20 includes the intermediate transfer belt 21 bridging between a drive roller 22 and a driven roller 23 and configured to circulatably run in a direction indicated by arrows, a primary transfer roller 24 disposed to face an associated one of the photosensitive drums 11 of the image formation sections 10Y to 10K with the intermediate transfer belt 21 being sandwiched therebetween, and a secondary transfer roller 25 disposed to face the drive roller 22 with the intermediate transfer belt 21 being interposed therebetween.

The feeding section 30 includes a cassette 31 configured to house sheets, e.g., paper sheets S in the present embodiment, a feeding roller 32 configured to feed, one by one, the paper sheets S from the cassette 31 to a delivery path 35, and delivery rollers 33, 34 configured to deliver the fed paper sheets S.

The fixing section 40 includes a fixing roller 41 and a pressure roller 42 pressed against the fixing roller 41.

The control section 50 is configured to control operation of the image processing section 10 to the fixing section 40 in a comprehensive manner to smoothly execute a job.

Specifically, in each of the image formation sections 10Y to 10K, the photosensitive drum 11 is charged by the charging roller 12 to which the charge voltage has been supplied. Then, each exposure section 13 of the image formation sections 10Y to 10K emits a light beam based on printing image data contained in a received job.

In each of the image formation sections 10Y to 10K, an electrostatic latent image is formed on the charged photosensitive drum 11 by the light beam emitted from the exposure section 13. Then, such an electrostatic latent image is developed using the toner, thereby forming a toner image. Subsequently, the toner image is primarily transferred onto the intermediate transfer belt 21 by electrostatic action of the primary transfer roller 24.

The operation of image formation in the colors corresponding respectively to the image formation sections 10Y to 10*k* is, at timings shifted from each other, executed from an upstream side toward a downstream side in a running direction such that toner images in the above-described colors are transferred to overlap with each other at the same position of the running intermediate transfer belt 21.

The paper sheet S is, in timing with such image formation, delivered from the cassette 31 of the feeding section 30 toward the secondary transfer roller 25. When the paper sheet S passes through a secondary transfer position 251 as a contact position between the secondary transfer roller 25 and a surface of the intermediate transfer belt 21, the overlapping toner images transferred in the above-described colors onto the intermediate transfer belt 21 are collectively secondarily transferred onto the paper sheet S by electrostatic action of the secondary transfer roller 25.

After secondary transfer of the toner images in the above-described colors, the paper sheet S is delivered to the fixing section 40, and then, is heated and pressurized when passing between the fixing roller 41 and the pressure roller 42 of the fixing section 40. In this manner, the toner on the paper sheet S is fused and fixed onto the paper sheet S. The paper sheet S having passed through the fixing section 40 is discharged to a catch tray 39 by discharge rollers 38.

A temperature detection sensor 71 and a humidity detection sensor 72 are, as a temperature/humidity detection unit, arranged right below the image processing section 10. The temperature detection sensor 71 is configured to detect a temperature (a machine inner temperature) in the printer 1, and the humidity detection sensor 72 is configured to detect a relative humidity (a machine inner humidity) in the printer 1. A detection result of each sensor is transmitted to the control section 50.

(2) Configuration of Control Section

Figure 2:
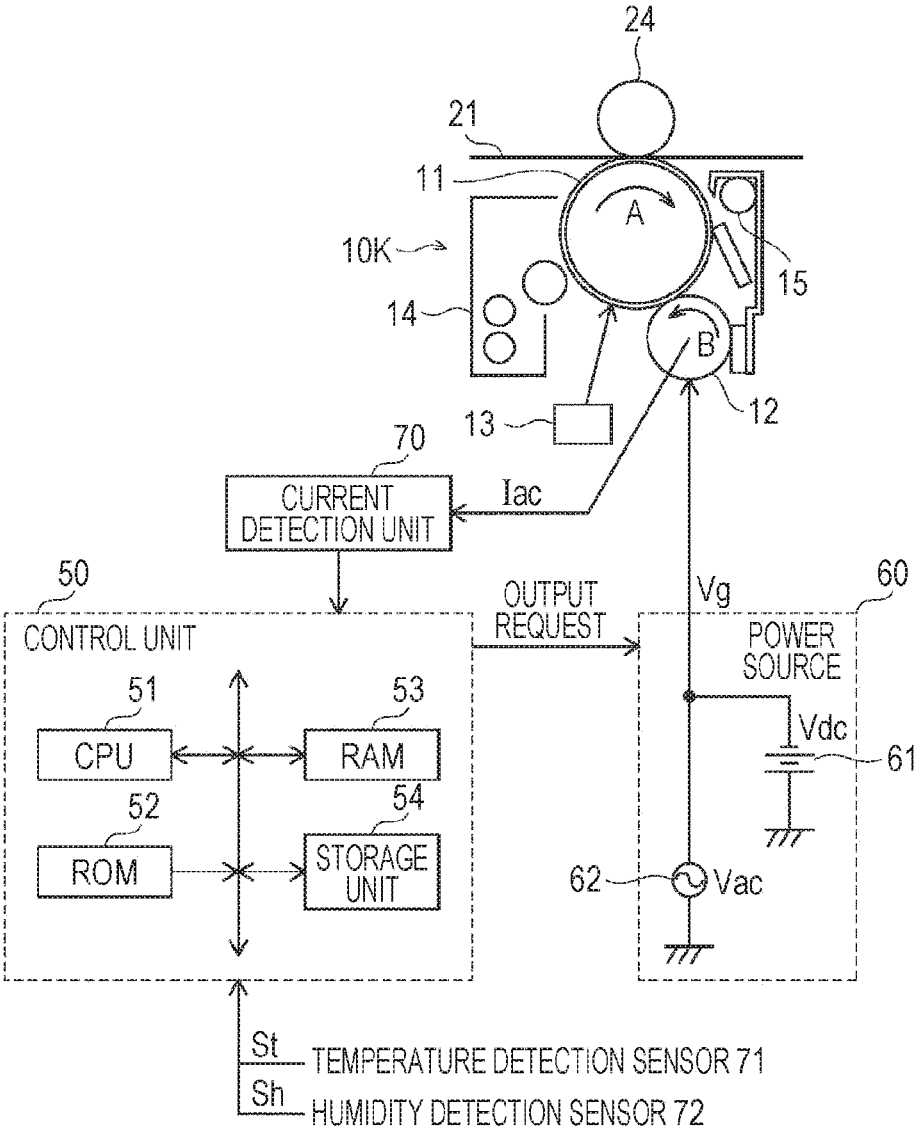
FIG. 2 is a block diagram of configurations of a control section and a power source.

FIG. 2 is a block diagram of the configuration of the control section 50, and also illustrates the image formation section 10K and the power source 60 and a current detection section 70 provided corresponding to the image formation section 10K.

The power source 60 is configured to supply a charge voltage (a voltage formed such that an AC voltage is superimposed on a DC voltage) Vg to the charging roller 12 of the image formation section 10K. In the present embodiment, the DC voltage has the same negative polarity as the charge polarity of the photosensitive drum 11, but may have a positive polarity depending on a device configuration.

The current detection section 70 is configured to detect an alternating current value Iac flowing through the charging roller 12 via the photosensitive drum 11 when the charge voltage Vg is supplied to the charging roller 12. Note that the power source 60 and the current detection section 70 are also provided corresponding to each of the other image formation sections 10Y to 10C. However, these sections basically have the same configuration as those of the image formation section 10K, and therefore, are not shown in FIG. 2. The image formation section 10K and the power source 60 and the current detection section 70 corresponding to the image formation section 10K will be described below.

The control section 50 includes, as main components, a central processing unit (CPU) 51, a read only memory (ROM) 52, a random access memory (RAM) 53, and a storage section 54.

The CPU 51 is configured to read a required program from the ROM 52 and control, in a comprehensive manner, operation of the image processing section 10, the intermediate transfer section 20, the feeding section 30, and the fixing section 40 at certain timing, thereby smoothly executing printing operation based on job data. Moreover, the CPU 51 is configured to provide the power source 60 with the request of outputting the charge voltage Vg. Such a request contains a request for a peak-to-peak voltage level (a peak-to-peak voltage value) Vpp of the AC voltage contained in the charge voltage Vg.

The RAM 53 serves as a work area of the CPU 51.

The storage section 54 is a non-volatile storage section, and is configured to store an environmental step table 81, a detection voltage table 82, a slope determination table 83, etc.

The power source 60 includes a combination of a DC power source circuit 61 and an AC power source circuit 62.

The DC power source circuit 61 is configured to output a predetermined DC voltage Vdc under control of the control section 50. Note that in the present embodiment, it is not particularly important to change the DC voltage Vdc for each image formation section. For this reason, it will be described below, for the sake of convenience, that the DC voltage Vdc is the same value among the image formation sections.

The AC power source circuit 62 includes, e.g., an AC transformer, and can change the magnitude of peak-to-peak voltage value Vpp of an AC voltage Vac to be output. Based on the request output from the control section 50, the AC power source circuit 62 outputs the AC voltage Vac including the requested magnitude of peak-to-peak voltage value Vpp. Note that as in the DC voltage Vdc, it will be described that the peak-to-peak voltage value Vpp of the AC voltage Vac is the same among the image formation sections.

An output end of the AC power source circuit 62 is connected to an output end of the DC power source circuit 61, and therefore, the charge voltage Vg is generated such that the AC voltage Vac is superimposed on the DC voltage Vdc. The generated charge voltage Vg is supplied to the charging roller 12.

In such a configuration, in non-image formation other than printing (image formation) onto the paper sheet S, the CPU 51 executes the charge voltage determination processing of determining, for each of the image formation sections 10Y to 10K, an optimal value of the peak-to-peak voltage value Vpp of the AC voltage of the charge voltage Vg in subsequent printing (subsequent image formation). The charge voltage Vg is hereinafter distinguished between a charge voltage Vg1 in printing and a charge voltage Vg2 output from the power source 60 during the charge voltage determination processing.

(3) Charge Voltage Determination Processing

Figure 3:
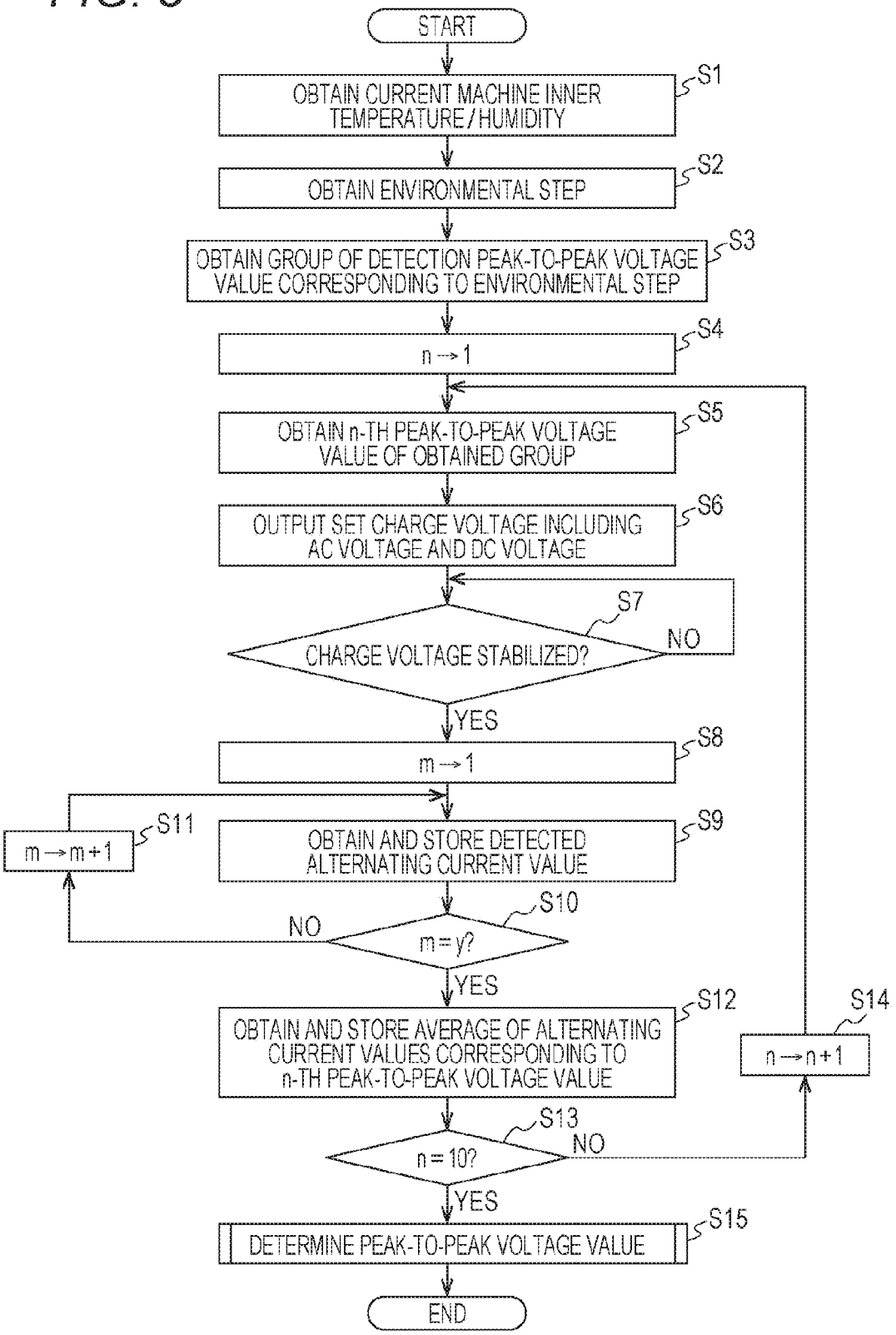
FIG. 3 is a flowchart of contents of charge voltage determination processing.

FIG. 3 is a flowchart of contents of the charge voltage determination processing in the image formation section 10K. Note that the same processing is simultaneously executed in the other image formation sections 10Y to 10C.

As illustrated in FIG. 3, an existing machine inner temperature and an existing machine inner humidity are obtained (step S1). Such an obtaining step is performed in such a manner that detection results of a machine inner temperature St and a machine inner humidity Sh of the temperature detection sensor 71 and the humidity detection sensor 72 are received.

Next, an environmental step is obtained (step S2). Such an obtaining step is performed by reference to the environmental step table 81 stored in the storage section 54 of the control section 50.

FIG. 4 illustrates a configuration example of the environmental step table 81.

As illustrated in FIG. 4, an environmental step 1, 2 . . . as an indicator of an absolute humidity level for each combination between the machine inner temperature and the machine inner humidity is written in the environmental step table 81. Note that, e.g., a machine inner temperature of "<15" in the environmental step table 81 indicates a temperature of lower than 15° C., and "<20" indicates a temperature within a range of equal to or higher than 15° C. and lower than 20° C. The same applies to, e.g., other temperature ranges of "<24" . . . and a machine inner humidity of "<18." The environmental step table 81 is produced in advance by, e.g., experiment at a fabrication stage or a development stage of the printer 1. Similarly, other tables described later are also produced in advance by, e.g., experiment.

In the present embodiment, the environmental steps are classified into 16 levels. The environmental steps 1 to 3 indicate low-temperature low-humidity environment (LL environment), the environmental steps 4 to 7 indicate normal-temperature normal-humidity environment (NN environment), the environmental steps 13 to 16 indicate high-temperature high-humidity environment (HH environment), and environmental steps 8 to 12 indicate environment which is between the NN environment and the HH environment and under which the machine inner temperature and the machine inner humidity are higher than those under the NN environment.

For example, when the existing machine inner temperature St is between 15° C. and 19° C. and the machine inner humidity Sh is between 18% and 31%, the environmental step "2" is obtained.

Referring back to FIG. 3, the group of detection peak-to-peak voltage values Vpp corresponding to the environmental step is obtained at step S3. Such an obtaining step is performed by reference to the detection voltage table 82 stored in the storage section 54 of the control section 50.

FIG. 5 illustrates a configuration example of the detection voltage table 82.

As illustrated in FIG. 5, groups A to D each including a plurality of different detection peak-to-peak voltage values Vpp (ten values in the present embodiment) are written for environmental step ranges in the detection voltage table 82. For each of a positive discharge range (a first discharge range) and a reverse discharge range (a second discharge range), each of the groups A to D includes at least two of ten detection peak-to-peak voltage values Vpp.

The positive discharge range described herein is a peak-to-peak voltage value Vpp range (see FIG. 7) of less than (Vth×2) when a charge start voltage at which charging of the photosensitive drum 11 begins is Vth. Such a range is a peak-to-peak voltage range in which charge transfer (charge transfer in a single direction) only occurs from the charging roller 12 to the photosensitive drum 11 when the charge voltage Vg is applied to the charging roller 12.

On the other hand, the reverse discharge range is a range (FIG. 7) of equal to or greater than (Vth×2). Such a range is a range in which charge transfer occurs in both directions between the photosensitive drum 11 and the charging roller 12.

In the present embodiment, (Vth×2) is 1500 V. FIG. 5 shows the example where for each of the groups A to D, first to fourth detection peak-to-peak voltage values Vpp in a positive discharge range of less than 1500 V are written and fifth to tenth detection peak-to-peak voltage values Vpp in a reverse discharge range of equal to or greater than 1500 V are written.

For example, when the environmental step obtained at step S2 belongs to a range of 1 to 3, the group A of the detection peak-to-peak voltage value Vpp in FIG. 5 is assigned. When the environmental step belongs to a range of 4 to 7, a range of 8 to 12, or a range of 13 to 16, the group B, C, D is assigned.

Referring back to FIG. 3, a first counter value n is initialized to one at step S4. The value of n indicates the number of the first to tenth detection peak-to-peak voltage value written in the detection voltage table 82 of FIG. 5.

In FIG. 3, an existing n-th detection peak-to-peak voltage value Vpp in the group selected at step S3 is obtained at step S5. For example, in the case where the group B is obtained, the existing n-th detection peak-to-peak voltage value Vpp which is a first detection peak-to-peak voltage value Vpp of 1020 V (FIG. 5) is obtained.

Then, at step S6, the AC voltage Vac and the DC voltage Vdc to be output from the power source 60 corresponding to the image formation section 10K are set, and the request of outputting the set AC voltage Vac and the set DC voltage Vdc is provided to the power source 60. Specifically, the peak-to-peak voltage value Vpp of the AC voltage Vac to be output from the AC power source circuit 62 of the power source 60 corresponding to the image formation section 10K is set to the detection peak-to-peak voltage value Vpp (1020 V in the above-described example) obtained at step S5. Moreover, the DC voltage Vdc to be output from the DC power source circuit 61 of the power source 60 is set to a preset value. Note that this value of the DC voltage Vdc is equivalent to a voltage value required for charging the photosensitive drum 11 to a predetermined potential in printing.

By execution of step S6, the charge voltage Vg2 formed such that the AC voltage having the detection peak-to-peak voltage value Vpp is superimposed on the DC voltage Vdc is output from the power source 60, and then, the output charge voltage Vg2 is supplied to the charging roller 12.

When output of the charge voltage is stabilized, specifically when a predetermined time period required for stabilization is elapsed ("Yes" at step S7), a second counter value m is initialized to one (step S8).

Next, the alternating current value Iac detected by the current detection section 70 corresponding to the image formation section 10K is obtained, and the obtained alternating current value Iac is stored in the RAM 53 (step S9).

Then, it is determined whether or not the second counter value m is equal to a predetermined value y (step S10). The predetermined value y described herein is a sampling number per rotation of the photosensitive drum 11, and is a natural number of equal to or greater than one. When m is not equal to the predetermined value y ("No" at step S10), an existing second counter value m is incremented by one (step S11), and then, the process returns to step S9.

Steps S9 to S11 are repeated until it is determined that m is equal to the predetermined value y. In this manner, each of the alternating current values Iac measured at y locations different from each other in a circumferential direction is held in the RAM 53 while the photosensitive drum 11 of the image formation section 10K rotates one time. When it is determined that m is equal to the predetermined value y ("Yes" at step S10), the average of the y alternating current values Iac is obtained, and the obtained average is stored as the alternating current value Iac corresponding to the n-th peak-to-peak voltage value Vpp in the RAM 53 (step S12). With such an average, variation in the detection value of the alternating current value Iac due to variation in the thickness of the photosensitive drum 11 can be smoothed.

Next, it is determined whether or not the first counter value n is 10 (step S13). When it is determined that n is not 10 ("No" at step S13), an existing first counter value n is incremented by one (step S14), and the process returns to step S5.

For example, when the existing value of n is two and the group obtained at step S3 is B, a second detection peak-to-peak voltage value Vpp of 1080 V (FIG. 5) is obtained at step S5.

Then, the processing of steps S6 to S13 is executed based on the obtained second detection peak-to-peak voltage value Vpp. Accordingly, the average of the alternating current values Iac when the charge voltage Vg2 including the AC voltage having the second detection peak-to-peak voltage value Vpp is supplied to the charging roller 12, and then, is stored in the RAM 53.

Then, it is determined again whether or not the first counter value n is 10 (step S13). When it is determined that n is not 10 ("No" at step S13), the existing first counter value n is incremented by one (step S14). Subsequently, the process returns to step S5, and the processing of step S5 and subsequent steps is executed.

The processing of steps S5 to S14 is repeatedly executed until it is determined that the first counter value n is 10. Accordingly, the average of the alternating current values Iac when the charge voltage Vg2 including the AC voltage having the detection peak-to-peak voltage value Vpp is supplied to the charging roller 12 is obtained sequentially for each of the third to tenth detection peak-to-peak voltage values Vpp in the obtained group, and then, is stored in the RAM 53.

That is, when four charge voltages Vg2 each having the peak-to-peak voltage value in the positive discharge range and six charge voltages Vg2 each having the peak-to-peak voltage value in the reverse discharge range are sequentially applied to the charging roller 12 of the image formation section 10K, the total of ten detected alternating current values Iac (ten averages) are stored in the RAM 53.

Each alternating current value Iac is stored in the RAM 53 such that the n-th detection peak-to-peak voltage value Vpp and the alternating current value Iac detected in supply of such a peak-to-peak voltage value Vpp are in one-to-one correspondence with each other. A one-to-one combination, which is stored in the RAM 53, of the detection peak-to-peak voltage value Vpp and the alternating current value Iac is hereinafter collectively referred to as "(Vpp, Iac)."

Execution of steps S1 to S14 by the control section 50 as described above can be regarded as execution of the first processing of sequentially supplying, in non-image formation, a plurality of charge voltages Vg2 from the power source 60 to the charging roller 12, the charge voltages Vg2 having the different peak-to-peak voltage values Vpp in the positive discharge range (the first discharge range) and the reverse discharge range (the second discharge range).

Then, when it is determined that the first counter value n is 10 ("Yes" at step S13), the peak-to-peak voltage value determination processing of determining an optimal value Vpp1 of the peak-to-peak voltage value is executed (step S15), and then, the charge voltage determination processing ends.

(4) Peak-to-Peak Voltage Value Determination Processing

Figure 6:
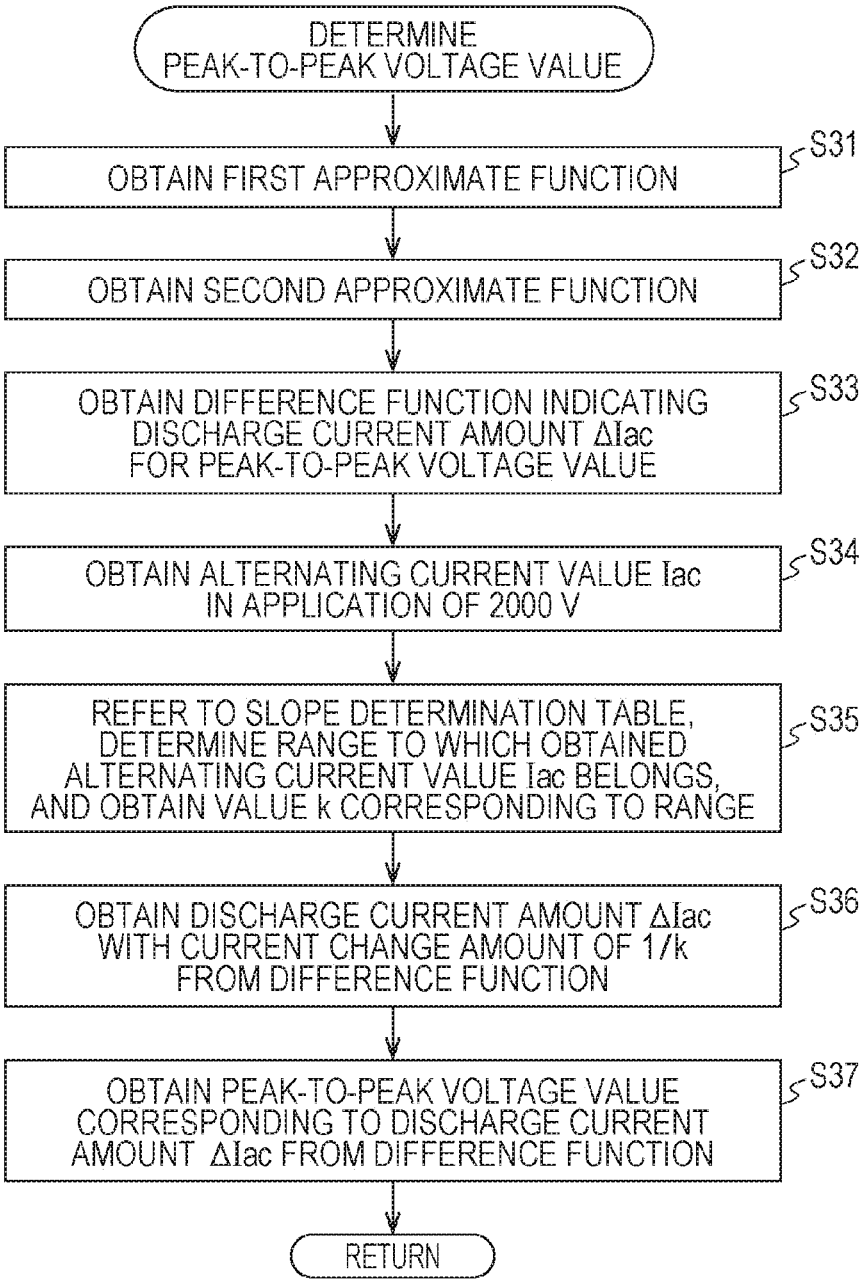
FIG. 6 is a flowchart of contents of a subroutine of peak-to-peak voltage value determination processing.
Figure 7:
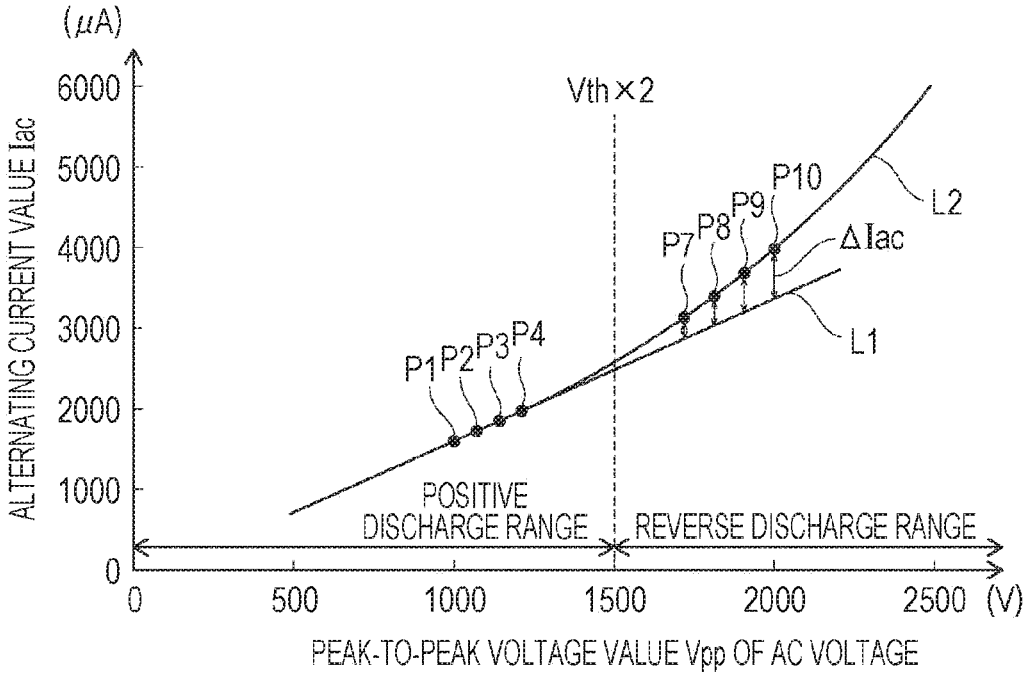
FIG. 7 is a graph of a relationship between a peak-to-peak voltage value and an alternating current value.

FIG. 6 is a flowchart of contents of a subroutine of the peak-to-peak voltage value determination processing. Moreover, FIG. 7 is a graph of a relationship between the alternating current value Iac and the peak-to-peak voltage value Vpp obtained by steps S1 to S14 of the above-described charge voltage determination processing. In FIG. 7, points P1 to P4 in the positive discharge range indicate points of the alternating current values Iac for the above-described detection peak-to-peak voltage values Vpp of n=1 to 4, and points P7 to P10 in the reverse discharge range indicate points of the alternating current values Iac for the above-described detection peak-to-peak voltage values Vpp of n=7 to 10.

First, a first approximate function is obtained as shown in FIG. 6 (step S31). The first approximate function is obtained in such a manner that values of (Vpp, Iac) at the points P1 to P4 in the positive discharge range shown in FIG. 7 are selected and data of the selected four points is linearly approximated by, e.g., a least-square technique. In this manner, a linear graph L1 (FIG. 7), i.e., a first approximate function of Iac=f1(Vpp) (note that Vpp<2×Vth), is obtained by approximation of properties (hereinafter referred to as "Vpp-Iac properties") of the alternating current value Iac with respect to the peak-to-peak voltage value Vpp in the positive discharge range.

Next, a second approximate function is obtained (step S32). The second approximate function is obtained in such a manner that values of (Vpp, Iac) at the points P7 to P10 in the reverse discharge range shown in FIG. 7 are selected and data of the selected four points is curve-approximated. In this manner, a curved graph L2 (FIG. 7), i.e., a second approximate function of Iac=f2(Vpp) (note that 2×Vth≤Vpp), is obtained by approximation of the Vpp-Iac properties in the reverse discharge range. Note that curve approximation is performed at step S32 because actual Vpp-Iac properties in the reverse discharge range are closer to a curved line than to a linear line.

Figure 8:
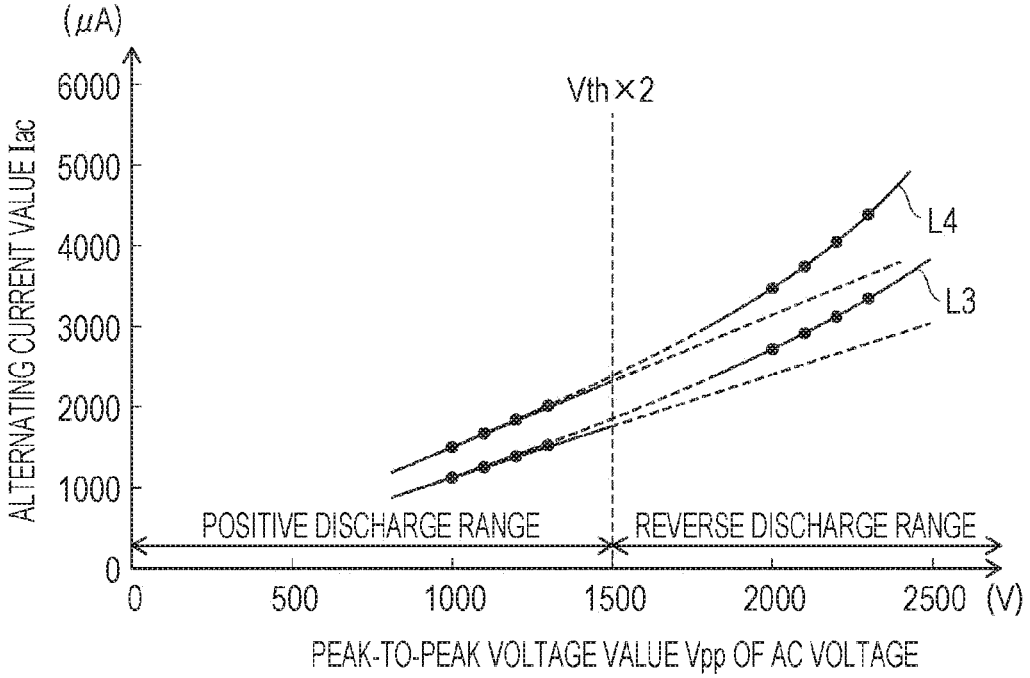
FIG. 8 is a graph of an example of the relationship between the peak-to-peak voltage value and the alternating current value at initial and terminal stages of the life of a photosensitive drum.

FIG. 8 is a graph of an example of the Vpp-Iac properties at an initial stage of the life of the photosensitive drum 11 and a terminal stage of the life of the photosensitive drum 11. A graph L3 indicates the initial stage of the life, and a graph L4 indicates the terminal stage of the life.

As shown in FIG. 8, it can be seen that not only the graph L3 indicating the initial stage of the life but also the graph L4 indicating the terminal stage of the life show, in the reverse discharge range, an exponential increase in the alternating current value Iac with an increase in the peak-to-peak voltage value Vpp. Moreover, the graph L4 indicating the terminal stage of the life is, as a whole, on an upper side of the graph L3 indicating the initial stage of the life, i.e., the graph L4 shows a greater alternating current value Iac than that of the graph L3.

This is because of the following reasons. That is, the thickness of the photosensitive drum 11 is generally reduced due to repeated printing operation. A greater number of printed sheets (i.e., closer to the terminal stage of the life) results in a smaller thickness, and an electric resistance value of the photosensitive drum 11 decreases by a thickness decrease.

Thus, even when the same peak-to-peak voltage value Vpp between the initial stage of the life and the terminal stage of the life is applied to the charging roller 12, a greater alternating current flows at the terminal stage of the life than at the initial stage of the life.

Note that as described above, the first approximate function is obtained from the values of (Vpp, Iac) at four points P1 to P4 in the positive discharge range, and the second approximate function is obtained from the values of (Vpp, Iac) at four points P7 to P10 in the reverse discharge range. However, the present invention is not limited to above. Each of the first and second approximate functions can be obtained from the values of (Vpp, Iac) at two or more points.

In each of the positive discharge range and the reverse discharge range, two or more different peak-to-peak voltage values Vpp each preferably have a difference of equal to or greater than a certain value, e.g., equal to or greater than 100 V, from an AC voltage value (=2×Charge Start Voltage Vth) indicating a boundary between the positive discharge range and the reverse discharge range. This is because a greater difference results in easier indication of the graph of the Vpp-Iac properties of each of the positive and reverse discharge ranges by the approximate function. Note that points indicating the above-described detection peak-to-peak voltage values Vpp of n=5 and n=6 are omitted from FIG. 7, but in some cases, one or both of these points may be added for calculation of the second approximate function.

Referring back to FIG. 6, a difference function (a third approximate function) indicating a discharge current amount ΔIac with respect to the peak-to-peak voltage value Vpp is obtained at step S33. Specifically, a value obtained by subtraction of the first approximate function from the second approximate function, i.e., f2(Vpp)−f1(Vpp), is derived as the difference function indicating ΔIac (a difference value of the alternating current value Iac: FIG. 7). In this light, execution of step S33 by the control section 50 can be regarded as execution of the second processing of obtaining the third approximate function indicating the difference value between the first and second approximate functions from detection results of the alternating current value Iac.

Figure 9:
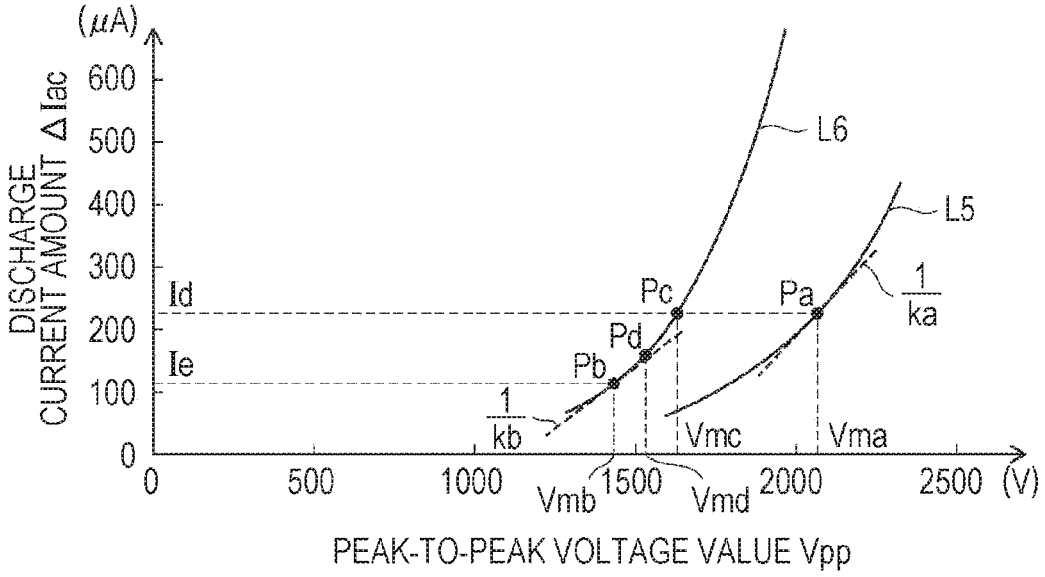
FIG. 9 is an example of a graph with a difference function at the initial and terminal stages of the life of the photosensitive drum.

FIG. 9 is an example of a graph with the difference function at the initial stage of the life and the terminal stage of the life of the photosensitive drum 11. A graph L5 indicates an example of the difference function at the initial stage of the life, and a graph L6 indicates an example of the difference function at the terminal stage of the life.

As shown in FIG. 9, the graph L6 indicating the terminal stage of the life shows, for the same peak-to-peak voltage value Vpp, a greater discharge current amount ΔIac than that of the graph L5 indicating the initial stage of the life, and also shows a greater increment of the discharge current amount ΔIac per unit peak-to-peak voltage.

This is because of the following reasons: it is considered that the increment of the discharge current amount ΔIac is greater at the terminal stage of the life than at the initial stage of the life due to, e.g., a decrease in the electric resistance value of the photosensitive drum 11, and increases with an increase in the peak-to-peak voltage value Vpp in the reverse discharge range. This can be also seen from the graph L4 (the terminal stage of the life) showing, in FIG. 8, a greater difference value (=ΔIac) from the first approximate function (a dashed line) than that of the graph L3 (the initial stage of the life).

The graph L6 (the terminal stage of the life) is in more upright shape than that of the graph L5 (the initial stage of the life) in FIG. 9. This is because of the following reasons. That is, at the initial stage of the life, the photosensitive drum 11 has a great thickness and a high electric resistance value. Thus, an alternating current is difficult to flow, and the discharge current amount ΔIac tends to be small. For these reasons, the graph L5 (the initial stage of the life) tends to have a lying-down shape as illustrated in FIG. 9. Conversely, at the terminal stage of the life, the electric resistance value of the photosensitive drum 11 decreases by a decrease in the thickness of the photosensitive drum 11, and therefore, an alternating current easily flows. Thus, the discharge current amount ΔIac tends to be great. For these reasons, the graph L6 (the terminal stage of the life) tends to transition to a more upright shape than that of the graph L5 (the initial stage of the life).

Referring back to FIG. 6, the alternating current value Iac detected when the peak-to-peak voltage value Vpp is 2000 V is obtained at step S34. In the example of FIG. 7, when Vpp is 2000 V at the point P10, an Iac of 4000 μA is obtained at the point P10. This value of 2000 V is one of six detection peak-to-peak voltage values Vpp in the reverse discharge range, and is herein determined in advance.

By referring, at step S35, to the slope determination table 83 stored in the storage section 54, the range to which the alternating current value Iac obtained at step S34 belongs is determined from different ranges written in the slope determination table 83. Then, a value k corresponding to the determined range is obtained.

FIG. 10 illustrates a configuration example of the slope determination table 83.

As shown in FIG. 10, the slope determination table 83 is a table in which for each of the different predetermined ranges (to 2400, 2401 to 2460, etc.) of the alternating current value Iac detected by the current detection section 70 when a peak-to-peak voltage value Vpp of 2000 V is supplied to the charging roller 12, a single value k (3.6, 3.3, etc.) is written corresponding to the environmental step (1 to 2, 3 to 4, etc.). The way to determine the value k will be described later.

For example, in the case where the environmental step obtained at step S2 as described above is two, if the alternating current value Iac obtained at step S34 is 2300 μA, such a value falls within a range of equal to or less than 2400 μA, and therefore, a k of 3.6 corresponding to the environmental step 2 is read. If the obtained alternating current value Iac is 2600 μA, such a value falls within a range of 2561 to 2630 μA, a k of 2.5 corresponding to the environmental step 2 is read.

Referring back to FIG. 6, the discharge current amount ΔIac is, at step S36, obtained at such a point that a change amount (i.e., a derivative value (dΔIac/dVpp)) of the discharge current amount ΔIac per unit peak-to-peak voltage is coincident with the inverse of the value k obtained at step S35, i.e., 1/k (a predetermined change amount value), in the difference function obtained at step S33.

For example, in the example of the graph L5 with the difference function as shown in FIG. 9, when the value k obtained at step S35 is ka, a value Id of the discharge current amount ΔIac at a point Pa at which the change amount (the slope of a tangent) of ΔIac is coincident with 1/ka is obtained. Moreover, in, e.g., the graph L6 with the difference function, when the value k obtained at step S35 is kb, a value Ie of the discharge current amount ΔIac at a point Pb at which the change amount of ΔIac is coincident with 1/kb is obtained. Note that as shown in FIG. 9, the change amount of ΔIac per unit peak-to-peak voltage in the difference function is only an increment in the present embodiment.

Referring back to FIG. 6, the peak-to-peak voltage value Vpp corresponding to the discharge current amount ΔIac obtained by step S36 in the above-described difference function is, at step S37, determined as the optimal peak-to-peak voltage value Vpp1 in image formation, and the process returns to a main routine.

For example, a peak-to-peak voltage value Vma at the point Pa is determined as the optimal value Vpp1 in the graph L5 shown in FIG. 9, and a peak-to-peak voltage value Vmb at the point Pb is determined as the optimal value Vpp1 in the graph L6. The optimal peak-to-peak voltage value Vpp1 determined by the peak-to-peak voltage value determination processing is stored in the storage section 54.

In subsequent printing at the image formation section 10K, the peak-to-peak voltage value Vpp of the AC voltage Vac to be output from the AC power source circuit 62 is set at the peak-to-peak voltage value Vpp1 currently stored in the storage section 54, and the DC voltage Vdc to be output from the DC power source circuit 61 is set at a predetermined value. As a result, the charge voltage Vg1 having the peak-to-peak voltage value Vpp1 determined as the optimal value as described above is supplied from the power source 60 to the charging roller 12 of the image formation section 10K in printing, and in this manner, the photosensitive drum 11 of the image formation section 10K is charged.

In this light, execution of steps S34 to S37 by the control section 50 can be regarded as execution of the third processing of determining one of the different predetermined ranges to which the detected alternating current value Iac in supply of the charge voltage Vg2 with one of the peak-to-peak voltage values Vpp in the reverse discharge range (the second discharge range) belongs, and determining, as the peak-to-peak voltage value in image formation, the peak-to-peak voltage value Vpp at the point at which the change amount of ΔIac in the difference function (the third approximate function) is coincident with the predetermined change amount value (=1/k) corresponding to the determined range.

The charge voltage determination processing can be executed at predetermined timing such as timing every time printing of a predetermined number of sheets (e.g., 1000 sheets) is executed, timing every time the number of rotation of the photosensitive drum 11 reaches a predetermined value, and timing when the change amount of the machine inner temperature/humidity per unit time exceeds a predetermined value (when an environment change amount exceeds a predetermined range).

The peak-to-peak voltage value Vpp1 stored in the storage section 54 by a single execution of the charge voltage determination processing is set as the peak-to-peak voltage value Vpp, which is to be output in printing, of the charge voltage Vg1 until subsequent charge voltage determination processing is executed. When the subsequent charge voltage determination processing is executed, the peak-to-peak voltage value Vpp1 stored in the storage section 54 is updated to a newly-determined peak-to-peak voltage value Vpp1. The same applies to the image formation sections 10Y to 10C other than the image formation section 10K.

(5) Reasons for Determining Peak-to-Peak Voltage Value by Using Slope Determination Table As shown in FIG. 8 described above, when the same peak-to-peak voltage value Vpp is applied to the charging roller 12, the alternating current value Iac is greater at the terminal stage of the life than at the initial stage of the life due to an electric resistance value decrease caused by reduction in the thickness of a photosensitive layer of the photosensitive drum 11.

Moreover, not only a decrease in the electric resistance value of the photosensitive drum 11 but also the electric resistance value of the charging roller 12 are involved. Specifically, a lower resistance value of the charging roller 12 results in a greater alternating current value Iac, and a higher resistance value of the charging roller 12 results in a smaller alternating current value Iac.

When the resistance value reaches a lower value side within a specification tolerance range of the electric resistance value of the charging roller 12, the alternating current value Iac increases. When toner particles are accumulated on, e.g., a roller surface due to long-term use of the charging roller 12, the resistance value might increase by such particle accumulation, leading to a smaller alternating current value Iac.

Thus, the peak-to-peak voltage value Vpp substantially the same as the optimal value at the initial stage of the life of the photosensitive drum 11 is not always the optimal value at the terminal stage of the life.

According to experiment conducted by the inventor(s) of the present invention, when the optimal value of the peak-to-peak voltage value Vpp is Vma at the initial stage of the life in the example of FIG. 9, the optimal value decreases to Vmb at the terminal stage of the life. Such an optimal value is properly determined as a value with which a high-quality reproduced image can be visually obtained, for example.

When these experimental results are found, if the above-described method of JP 2001-201920 A, i.e., the method for obtaining the peak-to-peak voltage value Vpp for which ΔIac is a predetermined value D, is employed, a peak-to-peak voltage value Vmc at a point Pc corresponding to ΔIac=Id (equivalent to the predetermined value D) in the graph L6 is obtained at the terminal stage of the life of the photosensitive drum 11 as shown in FIG. 9.

The voltage value Vmc is extremely greater than an optimal value Vmb, and cannot be taken as the optimal value corresponding to the terminal stage of the life of the photosensitive drum 11 or a value close to such an optimal value.

On the other hand, in the present embodiment, the method for obtaining the peak-to-peak voltage value Vpp1 by using the above-described difference functions and the slope determination table 83 is employed. This is because of the following reasons.

That is, the inventor(s) of the present invention has obtained the difference function at a point after a brand-new state of the photosensitive drum 11 and before the end of the life of the photosensitive drum 11. As a result, it has been found that the discharge current amount ΔIac indicated by each difference function increases with an increase in the peak-to-peak voltage value Vpp at both of the initial and terminal stages of the life of the photosensitive drum 11. Moreover, it has also been found that the change amount (=dΔIac/dVpp) of the discharge current amount ΔIac per unit peak-to-peak voltage tends to begin increasing from a smaller peak-to-peak voltage value Vpp at the terminal stage of the life than at the initial stage of the life.

Such tendency is applicable to the graph L5 at the initial stage of the life and the graph L6 at the terminal stage of the life in FIG. 9.

Specifically, the change amount of the discharge current amount ΔIac for the same peak-to-peak voltage value Vpp, i.e., the slope of the tangent, is greater in the graph L6 than in the graph L5. This shows that the slope of the tangent begins increasing from a smaller peak-to-peak voltage value Vpp in the graph L6 than in the graph L5.

Although not shown in FIG. 9, the difference function obtained for each period between the initial stage of the life and the terminal stage of the life similarly shows the tendency that the change amount of ΔIac begins increasing from a smaller peak-to-peak voltage value Vpp in a latter period than in a certain period.

That is, the entire graph of the difference function transitions, as in the graphs L5, L6 of FIG. 9, to shift in a direction in which the peak-to-peak voltage value Vpp decreases from the initial stage of the life toward the terminal stage of the life of the photosensitive drum 11 and to rise by rotation movement in a counterclockwise direction.

When the graph of the difference function is obtained for each point from the initial stage of the life to the end of the life based on the presence of graph transition as described above, and points at which the slope of the tangent is the same among these graphs are plotted, the peak-to-peak voltage value Vpp at each point decreases toward the end of the life.

Specifically, when the graph of the difference function at the initial stage of the life of the photosensitive drum 11 in FIG. 9 is L5, and each period between the initial and terminal stages of the life is A, B, C, . . . , a peak-to-peak voltage value at a point with the same slope (=1/ka) of the difference function of the point A as that at the initial stage of the life is Vma1 (<Vma), a peak-to-peak voltage value at a point with the same slope (=1/ka) of the difference function of the point B as that at the initial stage of the life is Vma2 (<Vma1), a peak-to-peak voltage value at a point with the same slope (=1/ka) of the difference function of the point C as that at the initial stage of the life is Vma3 (<Vma2), and so forth.

That is, transition of the photosensitive drum 11 from the brand-new state to the terminal stage of the life due to repeated printing is, in a linked manner, followed by a change in the peak-to-peak voltage value Vpp at the point with the same slope from a greater value to a smaller value. It can be said that such a relationship is substantially the same as the following relationship: as the photosensitive drum 11 transitions from the brand-new state to the terminal stage of the life, the resistance values of the photosensitive drum 11 and the charging roller 12 decrease, and accordingly, the optimal value of the peak-to-peak voltage value Vpp decreases.

The inventor(s) of the present invention has focused on such transition followed by the change in the peak-to-peak voltage value Vpp, and has derived as follows by experiment.

(a) The change amount (the slope of the tangent) of the discharge current amount ΔIac per unit peak-to-peak voltage at the point (the point Pa of the graph L5 in the example of FIG. 9) indicating the discharge current amount ΔIac corresponding to the optimal peak-to-peak voltage value Vpp in the difference function obtained at the initial stage of the life of the photosensitive drum 11 is 1/ka.

(b) The peak-to-peak voltage value Vpp (e.g., Vmd at the point Pd of the graph L6 in the example of FIG. 9) at the point with the slope 1/ka, which is the same as that at the initial stage of life, of the difference function obtained for, e.g., each point between the initial stage of the life and the end of the life of the photosensitive drum 11 and at the terminal stage of the life of the photosensitive drum 11 is the value close to the optimal value of the peak-to-peak voltage value Vpp at such a point.

According to above, as compared to the method for obtaining the peak-to-peak voltage value Vpp by at least using the fixed predetermined value D (=Id), the peak-to-peak voltage value Vpp closer to the optimal value properly obtained for each point is, as can be seen from FIG. 9, obtained until the end of the life of the photosensitive drum.

In other words, in the method using the fixed predetermined value D, an extremely-greater peak-to-peak voltage value Vpp than the optimal value is, at a certain point, obtained toward the terminal stage of the life as described above. However, this can be prevented.

In fact, an experimental machine was used to calculate the peak-to-peak voltage values at the initial and terminal stages of the photosensitive drum by both of the method using ΔIac fixed to the predetermined value D (=Id) and the method using a constant value of the slope (=dΔIac/dVpp) of the difference function. Consequently, results as shown in FIG. 11 were obtained.

As shown in FIG. 11, in the method using ΔIac fixed to the predetermined value D, a difference ΔVd between the optimal value of the peak-to-peak voltage and the calculated peak-to-peak voltage value Vpp is 0 V at the initial stage of the life, but the difference ΔVd is 260 Vat the terminal stage of the life. The peak-to-peak voltage value Vpp calculated at the terminal stage of the life is a value extremely greater than the optimal value (=1480 V) at such a point.

A difference ΔVd of 260 V greatly deviates from an acceptable peak-to-peak voltage value range assumed as not causing damage of the photosensitive drum, supposing that the acceptable range is, e.g., about 5% to 10% at a maximum with respect to the optimal value. Note that the acceptable range can be determined in advance by, e.g., experiment, and may be a voltage value range such as a range of equal to or greater than 50 V and less than 150 V, instead of the above-described percentage.

On the other hand, in the method using the constant value of the slope of the difference function, the difference ΔVd is 0 V at the initial stage of the life, and is only 20 V at the terminal stage of the life. These values are within the above-described acceptable range. Thus, it can be seen that the optimal peak-to-peak voltage value or the value close to such an optimal value is obtained.

Based on the above-described relationship between the life of the photosensitive drum 11 and the peak-to-peak voltage value Vpp, the inventor(s) of the present invention has further set plural groups of the photosensitive drum 11 and the charging roller 12, such as a group formed such that one of the photosensitive drum 11 or the charging roller 12 has a greater electric resistance value and the other one of the photosensitive drum 11 or the charging roller 12 has a smaller electric resistance value within the specification tolerance and a group formed such that both of the photosensitive drum 11 and the charging roller 12 have electric resistance values close to a center value of the tolerance, and has conducted various types of experiment, such as an endurance test and an environmental test, for the printers 1 with the above-described different groups. As a result, the inventor(s) has found as follows.

That is, in the experiment shown in FIG. 11, only a particular group of the photosensitive drum and the charging roller was used. However, in the case where the photosensitive drum and the charging roller with different properties, such as the electric resistance value, even within the design specification tolerance are combined together, the following has been found: due to influence of a change in charging properties between the initial stage of the life and the end of the life of the photosensitive drum, the calculated peak-to-peak voltage value Vpp might deviate from a proper range (a range in which an image is obtained with a certain image quality level or higher) when the slope of the difference function remains fixed to 1/ka at any points.

Such a charging property change mainly occurs due to a difference in the degree of a chronological resistance value change or the degree of time degradation between the photosensitive drum and the charging roller, variation in the resistance value of the charging roller, and an environmental change, for example.

Meanwhile, when a certain short time period of a long time period between the initial stage of the life and the end of the life of the photosensitive drum is focused, the photosensitive drum and the charging roller both exhibit a less change in the resistance value etc. and a much less change in the charging properties. In such a short time period, the optimal peak-to-peak voltage value Vpp or the value (the value within the above-described proper range) closer to such an optimal value as compared to that obtained by the method using the fixed predetermined value D is obtained even for the same slope.

The above-described short time period can be regarded as a period for which the charging property change is within a certain range. Considering a relationship in which a greater charging property change generally results in a greater change amount of the detection value of the alternating current value Iac, it can be said that the above-described short time period is a period for which the detection value of the alternating current value Iac is within a certain range.

Thus, the inventor(s) of the present invention has derived the following range from experiment: a certain alternating current value range which is included in an entire available range of the alternating current value Iac detected at a certain peak-to-peak voltage value Vpp such as 2000 V and in which the optimal peak-to-peak voltage value Vpp or the value close to such an optimal value can be obtained using the same (common) slope of the difference function.

A relationship between the range of the alternating current value Iac and the slope of the difference function will be described with reference to FIGS. 12A and 12B.

Figure 12A:
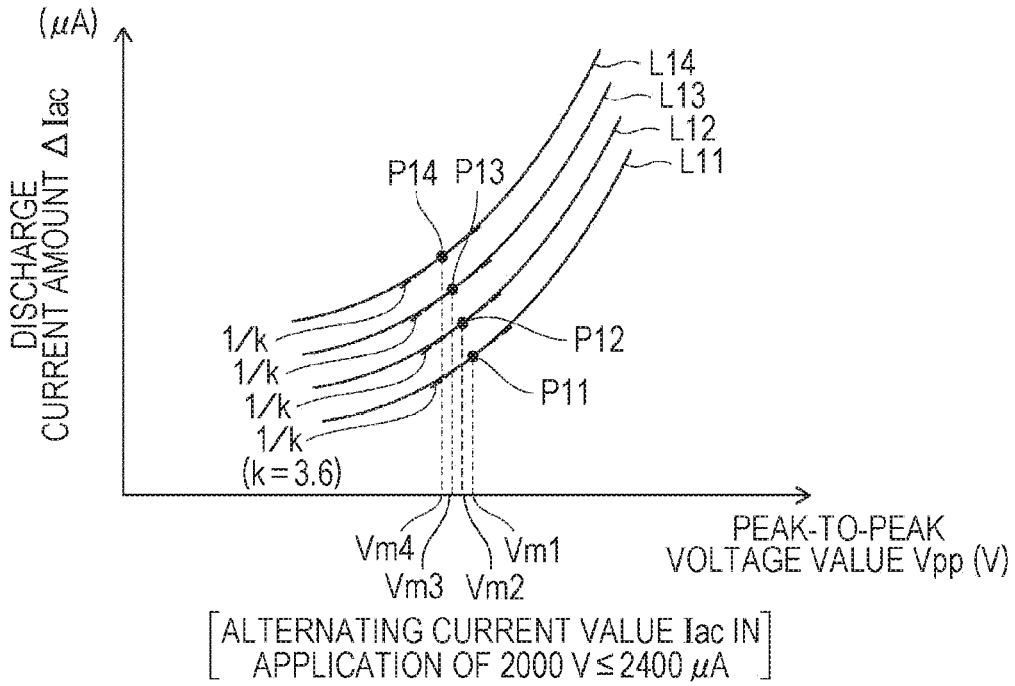
FIG. 12A is an example of a graph with a difference function when a detection value of the alternating current value is equal to or less than 2400 μA.

FIG. 12A shows examples of graphs L11, L12, L13, L14 with difference functions obtained for each point in the case where the detection value of the alternating current value Iac is within a range of equal to or less than 2400 μA when the charge voltage with a peak-to-peak voltage value Vpp of 2000 V is supplied to the charging roller 12 in a certain short time period after the brand-new state to the end of the life of the photosensitive drum 11.

Each of the graphs L12 to L14 shown in FIG. 12A is in such a shape that the graph L11 moves parallel to a direction in which the discharge current amount ΔIac increases. This is because of the following reasons. In the short time period, the thickness of the photosensitive drum 11 slightly decreases with an increase in the cumulative number of printed sheets, leading to an increase in the alternating current value Iac.

When printing was performed with such settings that peak-to-peak voltage values Vm1, Vm2, Vm3, Vm4 at points P11, P12, P13, P14 with the same value (k=3.6) of the slope 1/k of the tangent in each of the graphs L11 to L14 with the difference functions are set to the peak-to-peak voltage value Vpp1 at each point, a favorable image quality was visually obtained, and it was confirmed that almost no damage of the photosensitive drum 11 is caused.

Figure 12B:
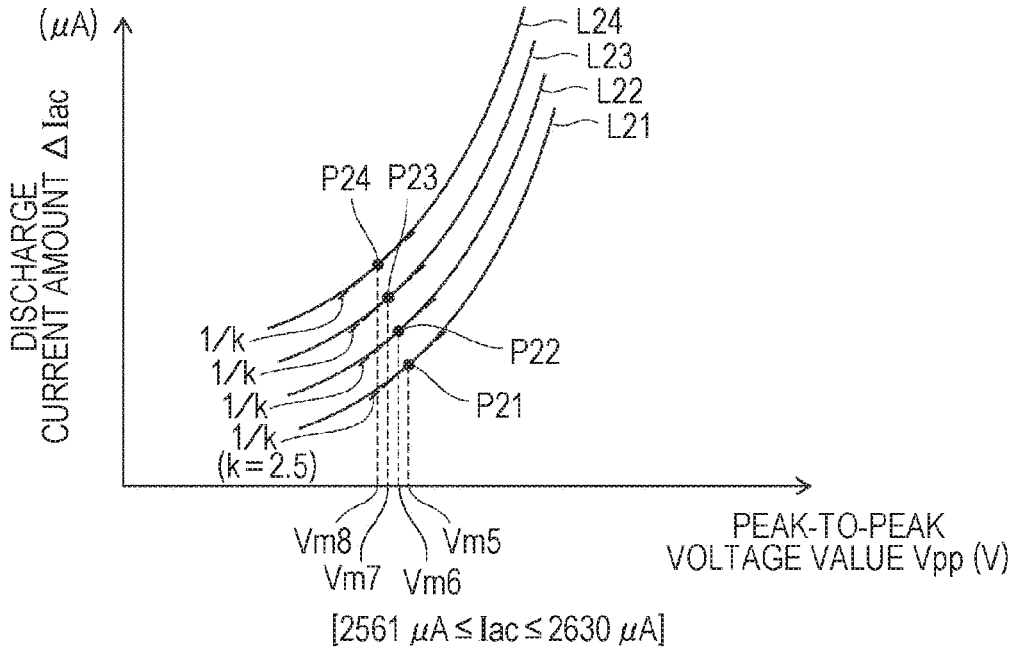
FIG. 12B is an example of a graph with a difference function when the detection value of the alternating current value is equal to or greater than 2561 μA and equal to or less than 2630 μA.

On the other hand, FIG. 12B shows examples of graphs L21, L22, L23, L24 with difference functions obtained for each point in the case where the detection value of the alternating current value Iac is within a range of equal to or greater than 2561 μA and equal to or less than 2630 μA when the charge voltage with a peak-to-peak voltage value Vpp of 2000 V is supplied to the charging roller 12 in a short time period different from that of FIG. 12A.

As in FIG. 12A, each of the graphs L22 to L24 shown in FIG. 12B is in such a shape that the graph L21 moves parallel to the direction in which the discharge current amount ΔIac increases.

When printing was performed with such settings that peak-to-peak voltage values Vm5, Vm6, Vm7, Vm8 at points P21, P22, P23, P24 with the same value (k=2.5) of the slope 1/k of the tangent in each of the graphs L21 to L24 with the difference functions are set to the peak-to-peak voltage value Vpp1 at each point, a favorable image quality was visually obtained, and it was confirmed that almost no damage of the photosensitive drum 11 is caused.

Results similar to above were obtained for a greater range of the detection value of the alternating current value Iac than the ranges shown in FIGS. 12A and 12B.

Thus, the available range of the alternating current value Iac was divided into a plurality of different ranges, and information indicating the value k corresponding to the environmental step in each range was obtained. Such obtained information is used for the slope determination table 83 shown in FIG. 10 as described above.

The alternating current value Iac corresponds to an associated one of the environmental steps 1 to 16 in the slope determination table 83. This is because of the following reasons: even in the case of the same peak-to-peak voltage value Vpp, when a discharge amount by the charging roller 12 changes due to a change in the machine inner temperature/humidity, the detection value of the alternating current value Iac also changes, and therefore, the value k suitable for the alternating current value Iac is obtained for each environmental step.

As seen from the slope determination table 83, the available range of the alternating current value Iac is divided into eight different ranges. For example, when the range of the alternating current value Iac for the environmental step 1 is equal to or less than 2400 μA, the value k is 3.6. Moreover, the value k is 3.3 in the case of a range of equal to or greater than 2401 μA and equal to or less than 2460 μA. It can be seen that a greater alternating current value Iac tends to result in a smaller value k. The different values k correspond, for the same environmental step, respectively to the different ranges of the alternating current value Iac because other factors than an environmental factor, such as a change in the thickness of the photosensitive drum 11 and the electric resistance value of the charging roller 12 due to the lives of the photosensitive drum 11 and the charging roller 12, can be also handled.

In addition, for each range of the alternating current value Iac, the value k varies according to the different environmental steps. Specifically, when the alternating current value Iac is within, e.g., a range of equal to or less than 2400 μA, the value k is 3.6 for the environmental step 2, and is 2.5 for the environmental step 4.

As shown in the slope determination table 83, there is a great difference in the alternating current value Iac detected in application of the same peak-to-peak voltage value, i.e., 2000 V, because this results from the change in the resistance values of the photosensitive drum 11 and the charging roller 12 and deterioration of the photosensitive drum 11 and the charging roller 12 as described above.

In the present embodiment, the slope determination table 83 produced considering the charging property change due to the above-described resistance value change of the photosensitive drum 11 and the charging roller 12 is stored in the storage section 54 in advance (e.g., in manufacturing of the printer 1). Thus, after delivery of the printer 1 to a user, the above-described charge voltage determination processing is performed at each point between the brand-new state to the end of the life of the photosensitive drum 11, and in this manner, the optimal peak-to-peak voltage value Vpp1 at each point can be obtained.

(6) Experimental Results

FIG. 13 is a table of results obtained by experimental calculation of the peak-to-peak voltage value Vpp in a configuration (an example) in which the value k is determined by the charge voltage determination processing and a configuration (a comparative example) in which the value k is fixed to a constant value.

The present experiment was performed for each of the following articles under the LL (low-temperature low-humidity) environment corresponding to the above-described environmental step 1: a configuration (a new article) in which a set of a new photosensitive drum 11 and a charging roller 12 with the upper electric resistance limit within the specification tolerance is mounted; and a configuration (a durable article) in which a set of a photosensitive drum 11 after 600 krot (six hundred thousand rotations) and a charging roller 12 with the lower electric resistance limit within the specification tolerance is mounted.

For the new article and the durable article, a peak-to-peak voltage value Vppt (equivalent to the optical value) optimal for obtaining a reproduced image with a favorable image quality was obtained in advance by, e.g., experiment. The peak-to-peak voltage value Vppt for the new article was 2400 V, and the peak-to-peak voltage value Vppt for the durable article was 1560 V.

In the case of the new article of the example, a k of 3.6 was, from the slope determination table 83, obtained for a detected alternating current value Iac of 2370 μA when a peak-to-peak voltage value Vpp of 2000 V is supplied to the charging roller 12, and a peak-to-peak voltage value Vpp of 2460 V was calculated. When the difference ΔVd between the calculated value and Vppt was taken, the difference ΔVd was 60 V. In the comparative example, a peak-to-peak voltage value Vpp of 2414 V was calculated for k (4 in the comparative example). When the difference ΔVd between the calculated value and Vppt was taken, the difference ΔVd was 14 V.

On the other hand, in the case of the durable article of the example, a k of 2.3 was obtained for a detected alternating current value Iac of 3582 μA in supply of a peak-to-peak voltage value Vpp of 2000 V. A peak-to-peak voltage value Vpp of 1623 V was calculated, and the difference ΔVd was 63 V. In the comparative example, a peak-to-peak voltage value Vpp of 1342 V was calculated, and the difference ΔVd was −218 V.

Figures 14, 15:
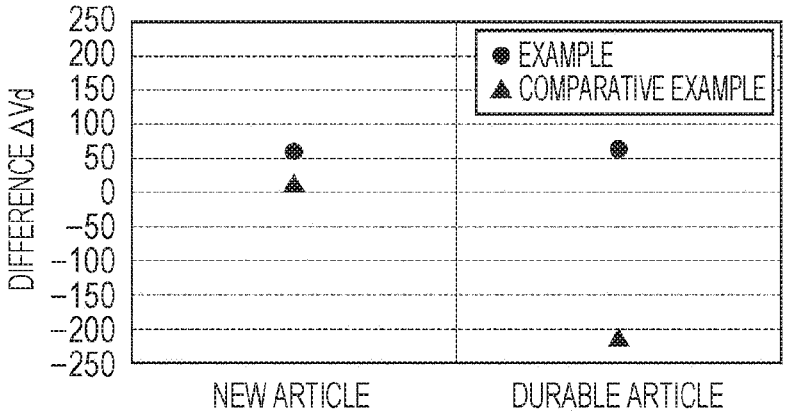
FIG. 14 is a graph for comparing the magnitude of difference ΔVd among new articles and durable articles in the example and the comparative example.
FIG. 15 is a table of an experimental result example under each type of LL environment and HH environment when the durable article is placed under each of these types of environment.

FIG. 14 is a graph for comparing the magnitude of difference ΔVd among the new articles and the durable articles in the example and the comparative example.

As shown in FIG. 14, the difference ΔVd is extremely small in both of the new article and the durable article of the example, whereas the difference ΔVd (=−218 V) for the durable article is extremely great in the comparative example.

The difference ΔVd being great on a negative side indicates that the calculated peak-to-peak voltage value Vpp is extremely less than the optimal value Vppt. As a result, scattering of dot-shaped toner images, i.e., so-called "fog," easily occurs in the printed reproduced image.

For both of the new article and the durable article of the example, the difference ΔVd falls within the above-described acceptable range (within a range of 5% to 10% with respect to the optimal value of the peak-to-peak voltage value), and it has been found that the peak-to-peak voltage value Vpp can be set within the proper range.

On the other hand, the value for the durable article of the comparative example falls outside the above-described acceptable range, and it has been found that the peak-to-peak voltage value Vpp might not be set within the proper range until the end of the life.

Note that FIGS. 13 and 14 do not show results of comparison between the example and the method using ΔIac fixed to the predetermined value D as described above. However, it has been found that when the peak-to-peak voltage value Vpp is obtained by the method using the fixed constant value D, such a value is extremely greater than the optimal value as shown in FIG. 9, and it has been confirmed that the peak-to-peak voltage value Vpp can be more properly obtained in the example.

FIG. 15 is a table of an experimental result example when the above-described durable article was placed under the HH (high-temperature high-humidity) environment corresponding to the environmental step 15 instead of the LL environment and the peak-to-peak voltage value Vpp was obtained by the method of the example. FIG. 15 also shows, for comparison, experimental results under the LL environment.

Under the LL environment, a peak-to-peak voltage value Vpp of 1623 V was calculated, and the difference ΔVd was 63 V, as shown in FIG. 15.

On the other hand, for the durable product under the HH environment, the peak-to-peak voltage value Vppt optimal for obtaining the reproduced image with the favorable image quality was obtained as 1300 V in advance by, e.g., experiment. Since the detection value of the alternating current value Iac was 4246 μA, a k of 1.8 was obtained from the slope determination table 83. Then, a peak-to-peak voltage value Vpp of 1386 V was calculated. The difference ΔVd was 86 V. This magnitude of difference ΔVd falls within the above-described acceptable range.

If a k of 1.8 was also obtained under the LL environment as in the HH environment, a peak-to-peak voltage value Vpp of 1749 V was calculated, and the difference ΔVd was 189 V, as shown in FIG. 15. Moreover, if a k of 2.3 was also obtained under the HH environment as in the LL environment, a peak-to-peak voltage value Vpp of 1272 V was calculated, and the difference ΔVd was −28 V, as shown in FIG. 15.

When the same value k as that under the LL environment is applied under the HH environment, the difference ΔVd might be a negative value. In this case, the calculated value falls below the optimal value Vppt, and there is a probability that fog occurs in the reproduced image. For this reason, it has been found that the value k suitable for environment is preferably applied.

As described above, in the present embodiment, the values k for obtaining the optimal peak-to-peak voltage value Vpp in the printer 1 are obtained in advance and written in the slope determination table 83. Then, the charge voltage determination processing is executed using the slope determination table 83 at each of optional points between the brand-new state and the end of the life of the photosensitive drum 11. In this manner, the optimal peak-to-peak voltage value Vpp at each point can be obtained with a favorable accuracy.

This can maintain a high-quality reproduced image for a long period of time without great damage on the photosensitive drum 11 and occurrence of fog etc.

Moreover, the slope determination table 83 has a versatile configuration in which each value k corresponds to an associated one of the different ranges of the alternating current value Iac. In such a configuration, a storage area can be significantly reduced as compared to a configuration with an enormous amount of information, such as a configuration in which each value k corresponds to an associated one of the alternating current values Iac within the available range of the alternating current value Iac. Consequently, the low-capacity inexpensive storage section 54 can be used.

Note that the configuration example where the inverse (=1/k) of the value k written in the slope determination table 83 is used as the change amount (the slope of the tangent) of the discharge current amount ΔIac per unit peak-to-peak voltage has been described above, but the present invention is not limited to the inverse. It may be configured such that a value indicating the change amount (the slope) itself is written in the slope determination table 83.

The present invention is not limited to the image formation device, and may relate to the method for determining the charge voltage. Further, the present invention may relate to the program for executing such a method by a computer. In addition, the program of the present invention can be recorded in various computer-readable recording media including, e.g., a magnetic tape, a magnetic disk such as a flexible disk, an optical recording medium such as a DVD-ROM, a DVD-RAM, a CD-ROM, a CD-R, a MO, and a PD, and a flash memory-type recording medium. Such a program may be produced and assigned in the form of the above-described recording medium, or may be transmitted and supplied in the form of program via various types of wired and wireless networks including the Internet, broadcasting, a telecommunications circuit, and satellite communication, for example.

<Variations>

The present invention has been described above with reference to the embodiment. Needless to say, the present invention is not limited to the above-described embodiment, and the following variations are conceivable.

(1) In the above-described embodiment, the value k is, with reference to the slope determination table 83, obtained from the alternating current value Iac detected when the charge voltage with a detection peak-to-peak voltage value Vpp of 2000 V is supplied to the charging roller 12. However, the peak-to-peak voltage value (hereinafter referred to as "Vppk") for obtaining the value k is not limited to 2000 V. It may be configured such that one, e.g., the maximum value, of the different peak-to-peak voltage values Vpp in the reverse discharge range is set as Vppk.

Note that in the case where the maximum value of the detection peak-to-peak voltage value varies according to the environmental step, specifically the case where the maximum value of the detection peak-to-peak voltage in the group A for the environmental steps 1 to 3 is, in FIG. 5, 2300 V and the maximum value of the detection peak-to-peak voltage in the group D for the environmental steps 13 to 16 is 2000 V, the slope determination table 83 is separately produced for each group.

Alternatively, it may be configured such that any one, at which the discharge current amount ΔIac (the difference value of the alternating current value: FIG. 7) is greater than zero, of the different detection peak-to-peak voltage values Vpp in the reverse discharge range is selected as Vppk instead of the maximum value.

For example, in the case where the charge voltage determination processing is executed at a certain point between the initial stage of the life and the terminal stage of the life, when each of the seventh to tenth ones of the fifth to tenth detection peak-to-peak voltage values Vpp in the group A shown in FIG. 5 satisfies a relationship of ΔIac>0, any one of the seventh to tenth values is selected as Vppk.

In this configuration, the detection peak-to-peak voltage values Vpp satisfying the relationship of ΔIac>0 cannot be specified in advance by the time point at which the charge voltage determination processing is executed. Thus, for each of the fifth to tenth detection peak-to-peak voltage values Vpp, the slope determination table 83 to be used when such a detection peak-to-peak voltage value Vpp is selected as Vppk is produced in advance.

Note that in any case, a greatest possible value is preferably set or selected as the peak-to-peak voltage value Vppk. FIG. 7 etc. show such properties that a greater peak-to-peak voltage value Vpp results in a greater alternating current value Iac. Thus, a greater detection range of the alternating current value Iac can be taken by a greater Vppk. Accordingly, the options for the value k for the alternating current value Iac can be increased.

(2) When the peak-to-peak voltage value Vppk is a voltage value in the reverse discharge range, it may be configured such that, e.g., a peak-to-peak voltage value Vppz different from the fifth to tenth detection peak-to-peak voltage values written in the detection voltage table 82 is used.

In such a configuration, a slope determination table 831 for the peak-to-peak voltage value Vppz is obtained in advance. When the first and second approximate functions are obtained, the peak-to-peak voltage values Vpp written in the detection voltage table 82 are, as described above, supplied sequentially to the charging roller 12. Subsequently, when the value k is obtained, the peak-to-peak voltage value Vppz is newly supplied to the charging roller 12, and the alternating current value Iac is determined at such a point. Then, the value k corresponding to one, to which the detected alternating current value Iac belongs, of different ranges of the alternating current value Iac written in the slope determination table 831 is read from the slope determination table 831.

(3) In the above-described embodiment, the tandem color printer has been described, but the present invention is not limited to such a printer. The present invention may relate to a black-and-white printer, other types of copiers, a facsimile device, and a combined machine thereof.

Moreover, the configuration example where an image carrier charged by a charging member is the photosensitive drum 11 has been described above, but the image carrier is not limited to the drum shape. The image carrier may be in a belt shape, for example.

Further, the configuration example where the charging roller 12 is used as the charging member, but the charging member is not limited to the roller shape. The charging member may be in a brush or blade shape. In addition, the contact arrangement configuration example where the charging roller 12 contacts the peripheral surface of the photosensitive drum 11 has been described, but the present invention is not limited to such an example. For example, the present invention is applicable to a configuration in which the charging member such as the charging roller 12 is disposed close to the peripheral surface of the image carrier such as the photosensitive drum 11 with a certain spacing.

(4) In the above-described embodiment, the configuration example where the power source 60 and the current detection section 70 are provided for each of the image formation sections 10Y to 10K, but the present invention is not limited to such an example. As long as the above-described charge voltage determination processing can be executed for each image formation section, it may be configured that a common power source and a common current detection section are provided for the image formation sections, for example.

(5) In the above-described embodiment, the example where the approximate function of f2(Vpp)−f1(Vpp) is taken as the difference function (the third approximate function) has been described, but the present invention is not limited to such an example. For example, f1(Vpp)−f2(Vpp) may be taken as the difference function. In this case, the current change amount in the difference function is a decrement.

Moreover, the approximate function f1 and the approximate function f2 are obtained, and the difference between these functions is taken as the difference function. However, as long as the function (the third approximate function) indicating the difference value ΔIac between the approximate function f1 and the approximate function f2 can be obtained, e.g., the following method may be used.

First, the first approximate function is obtained. Then, the difference ΔIac from the obtained first approximate function is calculated for each of four points P7 to P10 in FIG. 7.

The calculated difference ΔIac is plotted on the Y-axis, and each of the peak-to-peak voltage values Vpp at four points P7 to P10 is plotted on the X-axis. An approximate expression (an exponential function) indicating the difference ΔIac for the peak-to-peak voltage value Vpp is obtained as the third approximate function. Specifically, $f(Vpp)=\alpha\cdot\exp(\beta\cdot Vpp)$. In such an expression, α and β are coefficients.

In this method, the second approximate function itself is not calculated, but the function substantially the same as the above-described difference function is obtained. A method to be used can be determined in advance according to the device configuration.

(6) In the above-described embodiment, both of the machine inner temperature and the machine inner humidity are used as environmental conditions, but the present invention is not limited to these conditions. As long as the proper peak-to-peak voltage value Vpp1 at each point from the brand-new state to the end of the life of the photosensitive drum 11 can be determined, a configuration using only one of the temperature or the humidity as the environmental condition may be employed, for example.

In a device configuration providing almost no influence of a temperature/humidity change on determination of the peak-to-peak voltage value Vpp1, a configuration not taking the environmental steps into consideration can be employed, for example. In this configuration, only information indicating the different detection peak-to-peak voltages is written in the detection voltage table 82, and only information on correspondence between the alternating current value Iac and the value k is written in the slope determination table 83.

Further, the configuration example where the machine inner temperature and the machine inner humidity are detected by the temperature detection sensor 71 and the humidity detection sensor 72 as the detection unit has been described, but the present invention is not limited to the machine inner temperature/humidity. A configuration with a detection unit such as a sensor configured to detect a temperature and a humidity outside a machine (e.g., at the periphery of the printer 1) may be employed. This is because the charging properties etc. sometimes change due to a change in the temperature/humidity outside the machine. In the case of employing such a configuration, environmental steps corresponding to the temperature/humidity outside the machine are obtained in advance.

The values written in the environmental step table 81, the detection voltage table 82, and the slope determination table 83 and the above-described values for voltage, current, temperature/humidity, etc. are not limited to those described above. Proper values are set according to the device configuration.

Moreover, the above-described embodiment and each variation thereof may be used in combination to the extent possible.

The present invention can be broadly applied to an image formation device configured such that an image carrier is charged by a charging member.

The processing in the above-described embodiment may be implemented by software, or may be implemented using a hardware circuit. Moreover, the program for executing the processing in the above-described embodiment may be provided. Such a program may be recorded in a recording medium such as a CD-ROM, a flexible disk, a hard disk, a ROM, a RAM, and a memory card, and then, may be provided to a user. The program is executed by a computer such as a CPU. Moreover, the program may be downloaded to a device via a communication line such as the Internet.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image formation device in which an image carrier is charged by a charging member, comprising:

a power source configured to supply a charge voltage to the charging member, the charge voltage being formed such that an AC voltage is superimposed on a DC voltage;

a detection unit configured to detect an alternating current value flowing through the charging member; and a control unit configured to control a peak-to-peak voltage value of the AC voltage, wherein the control unit executes:

first processing of sequentially supplying a plurality of charge voltages from the power source to the charging member in non-image formation, the charge voltages having different peak-to-peak voltage values in a first discharge range in which only charge transfer from the charging member to the image carrier occurs and a second discharge range in which charge transfer occurs in both directions between the image carrier and the charging member;

second processing of obtaining, from an alternating current value detection result obtained by the detection unit when each charge voltage is supplied by the first processing, a third approximate function indicating a difference value between a first approximate function and a second approximate function, the first approximate function indicating an alternating current value for each peak-to-peak voltage value in the first discharge range and the second approximate function indicating an alternating current value for each peak-to-peak voltage value in the second discharge range; and third processing of determining one of different predetermined ranges to which a detection value of the alternating current value in supply of one of the charge voltages with an associated one of the peak-to-peak voltage values in the second discharge range belongs, and determining, as a peak-to-peak voltage value in image formation, a peak-to-peak voltage value at a point at which a change amount of the difference value per unit peak-to-peak voltage is coincident with a predetermined change amount value corresponding to the determined range in the third approximate function.

2. The image formation device according to claim 1, wherein the associated one of the peak-to-peak voltage values is one of the peak-to-peak voltage values in the second discharge range.

3. The image formation device according to claim 2, wherein the associated one of the peak-to-peak voltage values is a greatest one of the peak-to-peak voltage values in the second discharge range.

4. The image formation device according to claim 2, wherein the third approximate function is obtained by subtraction of the first approximate function from the second approximate function, and the associated one of the peak-to-peak voltage values is one of peak-to-peak voltage values which are included in the peak-to-peak voltage values in the second discharge range and for which the difference value is greater than zero.

5. The image formation device according to claim 1, further comprising:

a detection unit configured to detect an environmental condition inside or outside a machine, wherein for each of the different predetermined ranges, different values of the change amount is, in advance, associated respectively with different environmental conditions, and in the third processing, one of the different values of the change amount associated in advance with the determined range and corresponding to one of the different environmental conditions detected by the detection unit is set as the predetermined change amount value.

6. The image formation device according to claim 5, wherein the environmental condition is at least one of a temperature or a humidity inside the machine.

7. The image formation device according to claim 1, wherein the charging member is in a roller, brush, or blade shape contacting the image carrier or disposed close to the image carrier.

8. A non-transitory recording medium storing a computer readable control program of an image formation device in which an image carrier is charged by a charging member, wherein the image formation device includes:

a power source configured to supply a charge voltage to the charging member, the charge voltage being formed such that an AC voltage is superimposed on a DC voltage; and a detection unit configured to detect an alternating current value flowing through the charging member, the program causes a computer to execute:

a first processing step of sequentially supplying a plurality of charge voltages from the power source to the charging member in non-image formation, the charge voltages having different peak-to-peak voltage values in a first discharge range in which only charge transfer from the charging member to the image carrier occurs and a second discharge range in which charge transfer occurs in both directions between the image carrier and the charging member;

a second processing step of obtaining, from an alternating current value detection result obtained by the detection unit when each charge voltage is supplied by the first processing, a third approximate function indicating a difference value between a first approximate function and a second approximate function, the first approximate function indicating an alternating current value for each peak-to-peak voltage value in the first discharge range and the second approximate function indicating an alternating current value for each peak-to-peak voltage value in the second discharge range; and a third processing step of determining one of different predetermined ranges to which a detection value of the alternating current value in supply of one of the charge voltages with an associated one of the peak-to-peak voltage values in the second discharge range belongs, and determining, as a peak-to-peak voltage value in image formation, a peak-to-peak voltage value at a point at which a change amount of the difference value per unit peak-to-peak voltage is coincident with a predetermined change amount value corresponding to the determined range in the third approximate function, and a peak-to-peak voltage value of the AC voltage is controlled by the first to third processing steps.

9. The non-transitory recording medium storing a computer readable control program according to claim 8, wherein the associated one of the peak-to-peak voltage values is one of the peak-to-peak voltage values in the second discharge range.

10. The non-transitory recording medium storing a computer readable control program according to claim 9, wherein the associated one of the peak-to-peak voltage values is a greatest one of the peak-to-peak voltage values in the second discharge range.

11. The non-transitory recording medium storing a computer readable control program according to claim 9, wherein the third approximate function is obtained by subtraction of the first approximate function from the second approximate function, and the associated one of the peak-to-peak voltage values is one of peak-to-peak voltage values which are included in the peak-to-peak voltage values in the second discharge range and for which the difference value is greater than zero.

12. The non-transitory recording medium storing a computer readable control program according to claim 8, wherein the image formation device further includes a detection unit configured to detect an environmental condition inside or outside a machine, for each of the different predetermined ranges, different values of the change amount is, in advance, associated respectively with different environmental conditions, and in the third processing step, one of the different values of the change amount associated in advance with the determined range and corresponding to one of the different environmental conditions detected by the detection unit is set as the predetermined change amount value.

13. The non-transitory recording medium storing a computer readable control program according to claim 12, wherein the environmental condition is at least one of a temperature or a humidity inside the machine.

14. The non-transitory recording medium storing a computer readable control program according to claim 8, wherein the charging member is in a roller, brush, or blade shape contacting the image carrier or disposed close to the image carrier.

15. A method for controlling an image formation device in which an image carrier is charged by a charging member and which includes a power source configured to supply a charge voltage to the charging member, the charge voltage being formed such that an AC voltage is superimposed on a DC voltage, and a detection unit configured to detect an alternating current value flowing through the charging member, the method comprising:

a first processing step of sequentially supplying a plurality of charge voltages from the power source to the charging member in non-image formation, the charge voltages having different peak-to-peak voltage values in a first discharge range in which only charge transfer from the charging member to the image carrier occurs and a second discharge range in which charge transfer occurs in both directions between the image carrier and the charging member;

a second processing step of obtaining, from an alternating current value detection result obtained by the detection unit when each charge voltage is supplied by the first processing, a third approximate function indicating a difference value between a first approximate function and a second approximate function, the first approximate function indicating an alternating current value for each peak-to-peak voltage value in the first discharge range and the second approximate function indicating an alternating current value for each peak-to-peak voltage value in the second discharge range; and a third processing step of determining one of different predetermined ranges to which a detection value of the alternating current value in supply of one of the charge voltages with an associated one of the peak-to-peak voltage values in the second discharge range belongs, and determining, as a peak-to-peak voltage value in image formation, a peak-to-peak voltage value at a point at which a change amount of the difference value per unit peak-to-peak voltage is coincident with a predetermined change amount value corresponding to the determined range in the third approximate function, wherein a peak-to-peak voltage value of the AC voltage is controlled by the first to third processing steps.

* * * * *